US012502592B1

(12) United States Patent
Raposo

(10) Patent No.: US 12,502,592 B1
(45) Date of Patent: Dec. 23, 2025

(54) LAUNCH MONITOR UTILIZING A SMART GOLF BALL

(71) Applicant: Callaway Golf Company, Carlsbad, CA (US)

(72) Inventor: Mario Raposo, Carlsbad, CA (US)

(73) Assignee: Topgolf Callaway Brands Corp., Carlsbad, CA (US)

( * ) Notice: Subject to any disclaimer, the term of this patent is extended or adjusted under 35 U.S.C. 154(b) by 930 days.

(21) Appl. No.: 17/716,376

(22) Filed: Apr. 8, 2022

Related U.S. Application Data

(63) Continuation-in-part of application No. 17/162,072, filed on Jan. 29, 2021, now Pat. No. 11,344,785, which is a continuation of application No. 16/814,751, filed on Mar. 10, 2020, now Pat. No. 10,918,929, which is a continuation of application No. 16/509,232, filed on Jul. 11, 2019, now Pat. No. 10,688,366.

(60) Provisional application No. 63/174,689, filed on Apr. 14, 2021, provisional application No. 62/697,584, filed on Jul. 13, 2018.

(51) Int. Cl.
*A63B 69/36* (2006.01)
*A63B 37/00* (2006.01)

(52) U.S. Cl.
CPC ..... *A63B 69/3658* (2013.01); *A63B 37/0051* (2013.01); *A63B 37/00922* (2020.08); *A63B 69/3655* (2013.01); *A63B 2220/34* (2013.01); *A63B 2220/833* (2013.01)

(58) Field of Classification Search
CPC .... A63B 2024/0028; A63B 2024/0031; A63B 2024/0034; A63B 2024/0037; A63B 2024/004; A63B 2024/005; A63B 2024/0053; A63B 2024/0056; A63B 37/0003; A63B 37/0075; A63B 43/004; A63B 43/06
See application file for complete search history.

(56) References Cited

U.S. PATENT DOCUMENTS 1,737,000 A * 11/1929 Decker ..... A63B 69/3623 473/191
3,351,347 A * 11/1967 Smith ..... A63B 43/06 362/802
3,826,501 A * 7/1974 Hiromachi ..... A63B 69/3691 473/158
4,473,229 A * 9/1984 Kloppenburg ..... A63B 37/0003 473/357
4,945,424 A * 7/1990 Hiroki ..... H04N 23/531 358/906
5,020,802 A * 6/1991 af Strom ..... A63B 69/3623 473/165
6,042,487 A * 3/2000 Schrimmer ..... A63B 43/06 473/370

(Continued)

FOREIGN PATENT DOCUMENTS

CA 2722573 A1 * 11/2009 ..... A63B 24/0021
EP 1176171 A2 * 1/2002 ..... C08K 3/36

*Primary Examiner* — Alvin A Hunter
(74) *Attorney, Agent, or Firm* — Michael A. Catania

(57) ABSTRACT

A method and system for obtaining golf ball launch parameters is disclosed herein. The system comprises a golf ball with sensors, a vertical wall, and a monitor. The processor is configured to calculate the launch angle of the golf ball based on the height of the golf ball at impact with the vertical wall.

3 Claims, 31 Drawing Sheets

(56) References Cited

U.S. PATENT DOCUMENTS 6,252,632 B1 * 6/2001 Cavallaro ..... H04N 5/262 348/592
6,440,012 B1 * 8/2002 Nesbitt ..... A63B 37/04 473/372
6,450,898 B1 * 9/2002 Nesbitt ..... A63B 37/0003 473/372
6,525,139 B2 * 2/2003 Takesue ..... C08F 8/30 473/378
6,692,380 B2 * 2/2004 Sullivan ..... A63B 37/02 473/376
6,712,487 B2 * 3/2004 Liou ..... A63B 37/0003 362/555
6,780,126 B2 * 8/2004 Ladd ..... A63B 37/12 473/376
6,786,838 B2 * 9/2004 Sullivan ..... B29C 70/70 473/376
6,806,347 B2 * 10/2004 Hogge ..... A63B 37/0003 528/396
6,852,043 B2 * 2/2005 Sullivan ..... A63B 37/0003 473/374
6,855,073 B1 * 2/2005 Keller ..... A63B 37/0083 473/374
6,916,254 B2 * 7/2005 Ladd ..... A63B 37/0003 473/376
7,014,575 B2 * 3/2006 Sullivan ..... A63B 37/00621 473/371
7,115,049 B2 * 10/2006 Sullivan ..... A63B 37/00621 473/376
7,221,323 B2 * 5/2007 Schantz ..... H01Q 9/00 455/96
7,614,959 B1 * 11/2009 Gentile ..... A63B 43/004 473/52
7,691,009 B2 * 4/2010 Savarese ..... A63B 37/0003 473/316
8,192,862 B2 * 6/2012 Yamada ..... H01M 50/119 429/185
8,353,791 B2 * 1/2013 Holthouse ..... A63B 24/0062 463/40
8,373,658 B2 * 2/2013 Ye ..... G06F 3/038 345/158
8,425,350 B2 * 4/2013 Savarese ..... A63B 43/00 156/145
8,446,255 B2 * 5/2013 Balardeta ..... G06K 19/0723 340/539.3
8,540,583 B2 * 9/2013 Leech ..... G01S 17/74 473/353
8,747,241 B2 * 6/2014 Molinari ..... A63B 37/0003 473/131
8,748,536 B2 * 6/2014 Comeau ..... A63B 37/12 525/530
8,764,588 B2 * 7/2014 Gill ..... A63B 59/50 473/465
8,876,008 B2 * 11/2014 Van Driel ..... G06K 19/045 340/572.1
8,972,102 B2 * 3/2015 Reindl ..... A63B 43/004 701/32.4
8,974,266 B2 * 3/2015 Liao ..... G02B 5/0236 524/588
9,217,753 B2 * 12/2015 Molinari ..... G01H 1/00
9,265,991 B2 * 2/2016 Hohteri ..... H04M 1/72412
9,498,680 B2 * 11/2016 Luciano, Jr. ..... A63B 43/004
9,522,306 B1 * 12/2016 Ganson ..... A63B 43/004
9,597,567 B1 * 3/2017 Tran ..... A63B 71/06
9,682,305 B2 * 6/2017 Kim ..... A63B 71/0619
9,694,247 B2 * 7/2017 Nurnberg ..... A63B 43/004
10,204,456 B2 * 2/2019 Kudirka ..... G02B 27/017
10,232,225 B1 * 3/2019 Oberc ..... A63B 69/3655
10,252,117 B1 * 4/2019 Simonds ..... B29C 43/18
10,315,077 B2 * 6/2019 Komatsu ..... A63B 43/004
10,428,216 B2 * 10/2019 Sullivan ..... A63B 37/0076
10,493,329 B1 * 12/2019 Luciano, Jr. ..... A63B 37/0003
10,688,366 B1 * 6/2020 Petrich ..... A63B 37/0051
10,751,575 B2 * 8/2020 Komatsu ..... A63B 37/00921
2003/0096664 A1 * 5/2003 Jordan ..... A63B 37/0003 473/374
2005/0227792 A1 * 10/2005 McCreary ..... A63B 24/0021 473/409
2005/0233815 A1 * 10/2005 McCreary ..... A63B 71/06 473/131
2006/0105857 A1 * 5/2006 Stark ..... A63B 43/00 473/353
2007/0173349 A1 * 7/2007 Eng ..... A63B 37/0003 473/570
2018/0214758 A1 * 8/2018 Mosher ..... A63B 69/3655
2019/0036360 A1 * 1/2019 Zilles ..... A63B 24/0021

* cited by examiner

LAUNCH MONITOR UTILIZING A SMART GOLF BALL

CROSS REFERENCES TO RELATED APPLICATIONS

The Present Application claims priority to U.S. Provisional Patent Application No. 63/174,689, filed on Apr. 14, 2021, and the Present Application is a continuation-in-part application of U.S. patent application Ser. No. 17/162,072, filed on Jan. 29, 2021, which is a continuation application of U.S. patent application Ser. No. 16/814,751, filed on Mar. 10, 2020, now U.S. Pat. No. 10,918,929, issued on Feb. 16, 2021, which is a continuation application of U.S. patent application Ser. No. 16/509,232, filed on Jul. 11, 2019, now U.S. Pat. No. 10,688,366, issued on Jun. 23, 2020, which claims priority to U.S. Provisional Patent Application No. 62/697,584, filed on Jul. 13, 2018, each of which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

The present invention relates to golf balls. Particularly to golf balls with internal electronics.

Description of the Related Art

Most patents that have been filed are of communicating between a ball and a device, which only involves trying to find the golf ball using RFID type circuitry. Most of the designs will only be successful in getting a user close to the position of the golf ball.

In regards to the spin measurement, most spin measurement devices use Doppler technology to measure the ball as it spins, this method produces inconsistent results that have aliasing issues at times.

Quimby et al., U.S. Pat. No. 5,910,057 for a Golf Ball With Distance And Locating System discloses a golf ball having a transmitter therein which emits a signal at a frequency of 900 MegaHertz.

BRIEF SUMMARY OF THE INVENTION

The present invention is a launch monitor that utilizes a smart golf ball. The golf ball comprises inertial motion sensors (Accelerometer+Magnetometer). The axes of both magnetometer and accelerometer preferably have to share the same orientation.

By placing the magnetometer in the ball, the exact spin values are recorded (up to 5000 RPM).

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 31:
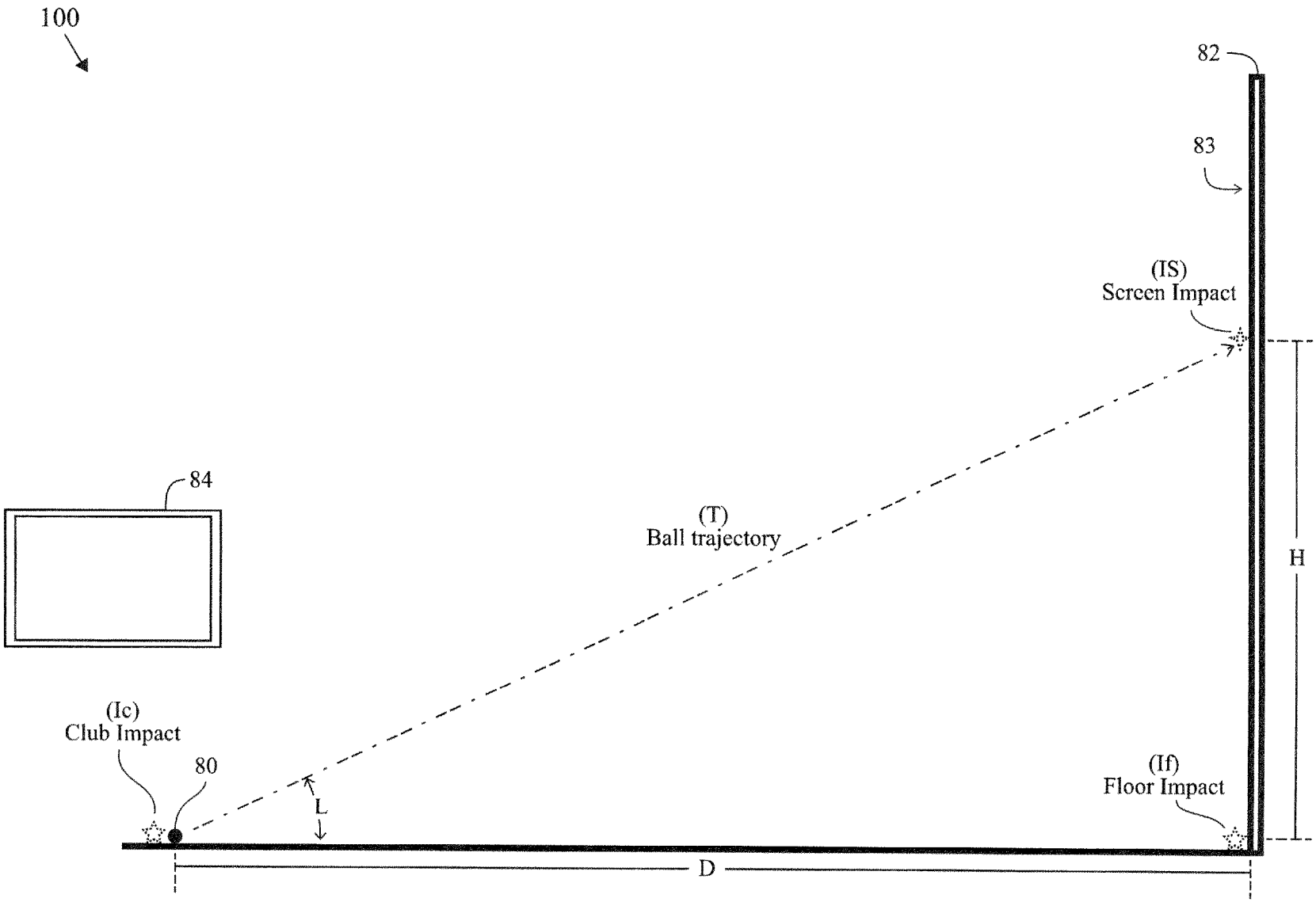
FIG. 31 illustrates a system for obtaining golf ball launch parameters.

A system 100, as shown in FIG. 31, for obtaining golf ball launch parameters preferably includes a vertical wall 82, a golf ball 80 comprising multiple sensors and a wireless transceiver, and a monitor 84 comprising a processor and a transceiver for collecting information from the sensors of the golf ball 80. The sensors of the golf ball 80 comprises of an accelerometer and a magnetometer.

The ball 80 is teed at a known distance D to a vertical wall 82, preferably with a clear vertical bounce screen 83.

The processor is configured to calculate a height H of the golf ball at impact, the launch angle L of the golf ball, a ball speed, a spin and spin axis, and a path angle of the golf ball until wall impact.

The system first calculates the height H of the golf ball at impact based on the time the golf ball takes to fall to the floor after impact with the vertical wall.

The system next calculates the launch angle L of the golf ball based on the height H of the golf ball at impact with the vertical wall.

The system next calculates ball speed based on the time from club impact to wall impact and distance D from the ball at rest to the ball at impact height H.

The system next calculates spin and spin axis from magnetometer readings: Capture the 3-axis of magnetometer data during ball flight up to wall impact; The rotations will result in a sinusoidal oscillations of all 3 axis readings; The averages of these oscillations on each axis define the spin axis; The resultant X, Y, magnetometer readings define total spin.

Figure 33:
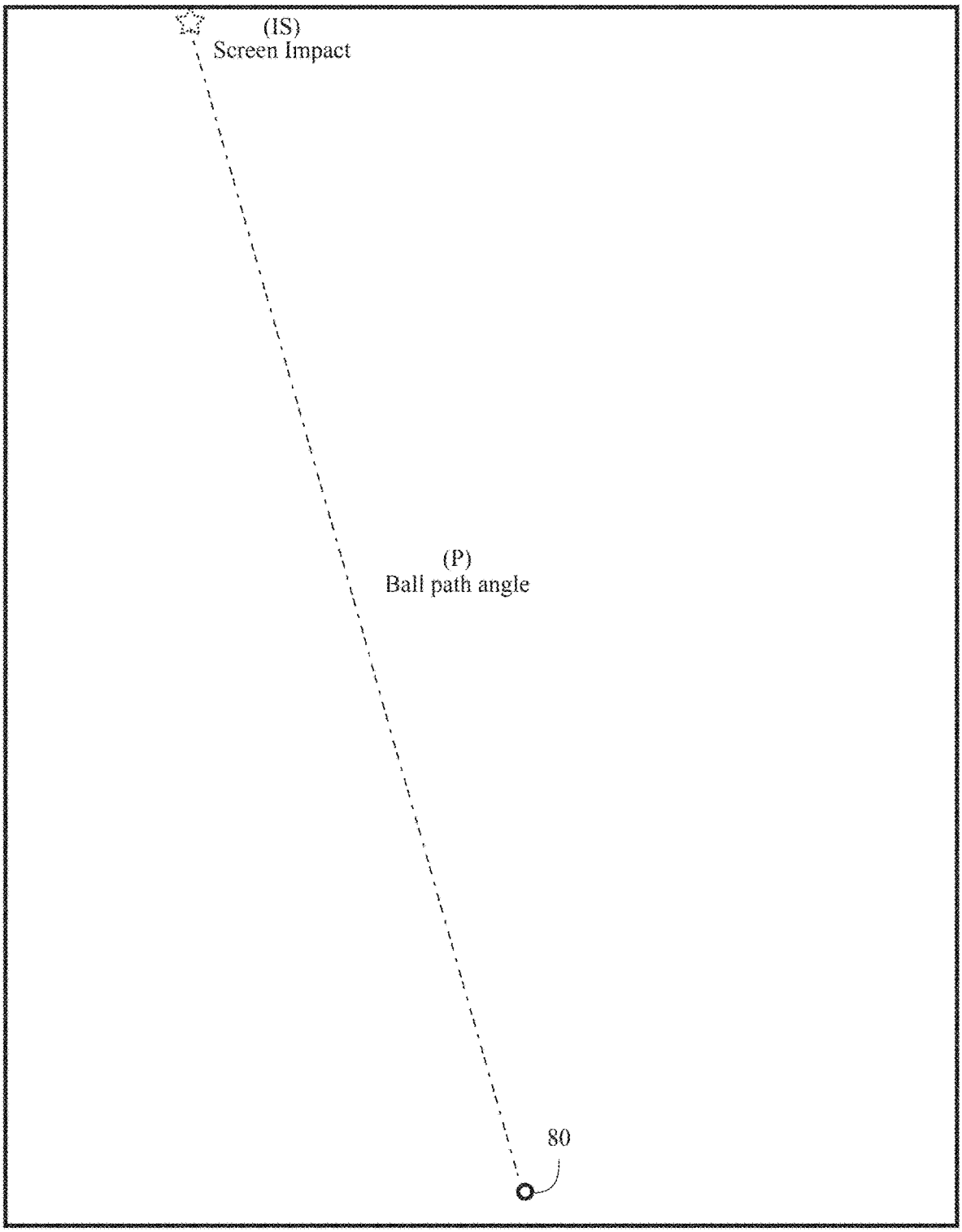
FIG. 33 illustrates a golf ball path angle.

The system next calculates the path angle of the ball 80 until wall impact, as shown in FIG. 33, based on Spin axis in relation to gravitational reference plane defined by the values for the Accelerometer and Magnetometer at rest.

The two main advantages of the present invention to a golfer is a golf ball that records spin and a golf ball that is easily located.

A magnetometer, preferably running at 85 Hz, located inside of a golf ball preferably measures spins of up to 5000 rotations per minute ("RPM"). Measuring higher spin rates is also possible.

Figure 32:
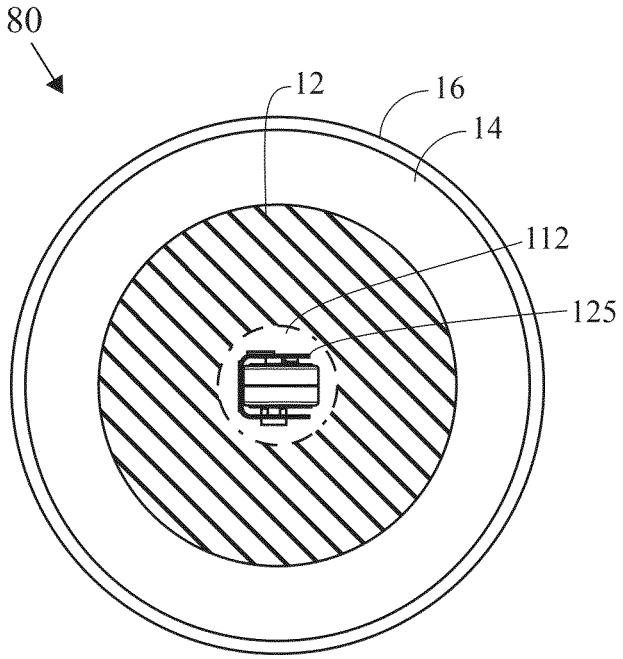
FIG. 32 illustrates a golf ball of a system.

The entire circuitry 125 is preferably located inside of a hard plastic molded sphere 112, as shown in FIG. 32.

Data is transferred via a BLUETOOTH low energy ("BLE") radio to a mobile device (preferably a mobile phone such as an iPHONE mobile phone from Apple, Inc. or a GALAXY mobile phone from Samsung, Inc.).

The circuitry inside the golf ball preferably activates at impact using a shock switch for power savings. At rest, and after a shot, the golf ball continues to send data, and returns to a sleep mode every second until a golfer locates the golf ball using a mobile application on a mobile device and the golfer acknowledges locating the golf ball in the mobile application.

A golf ball is preferably located using triangulation of the received signal strength indication ("RSSI") from the golf ball to the mobile device. The user is preferably instructed to move forward and to the side to generate sufficient space for the triangulation.

Internal circuitry 125 is embedded within the golf ball 80, as shown in FIG. 32. The internal circuitry preferably comprises at least a BLUETOOTH Low Energy radio ($5^{th}$ generation), a processor, a magnetometer, an accelerometer, and a battery. The internal circuit may also have a memory. A KIONIX chip is preferred. The $5^{th}$ generation BLUETOOTH Low Energy radio has a range of at least 700 meters. Triangulation is used to find a golf ball on course. The battery is preferably a 2032 coin cell. A NF52 Nordic processor is preferably utilized. A KIONIX 3-axis accelerometer is preferably utilized.

Figure 34:
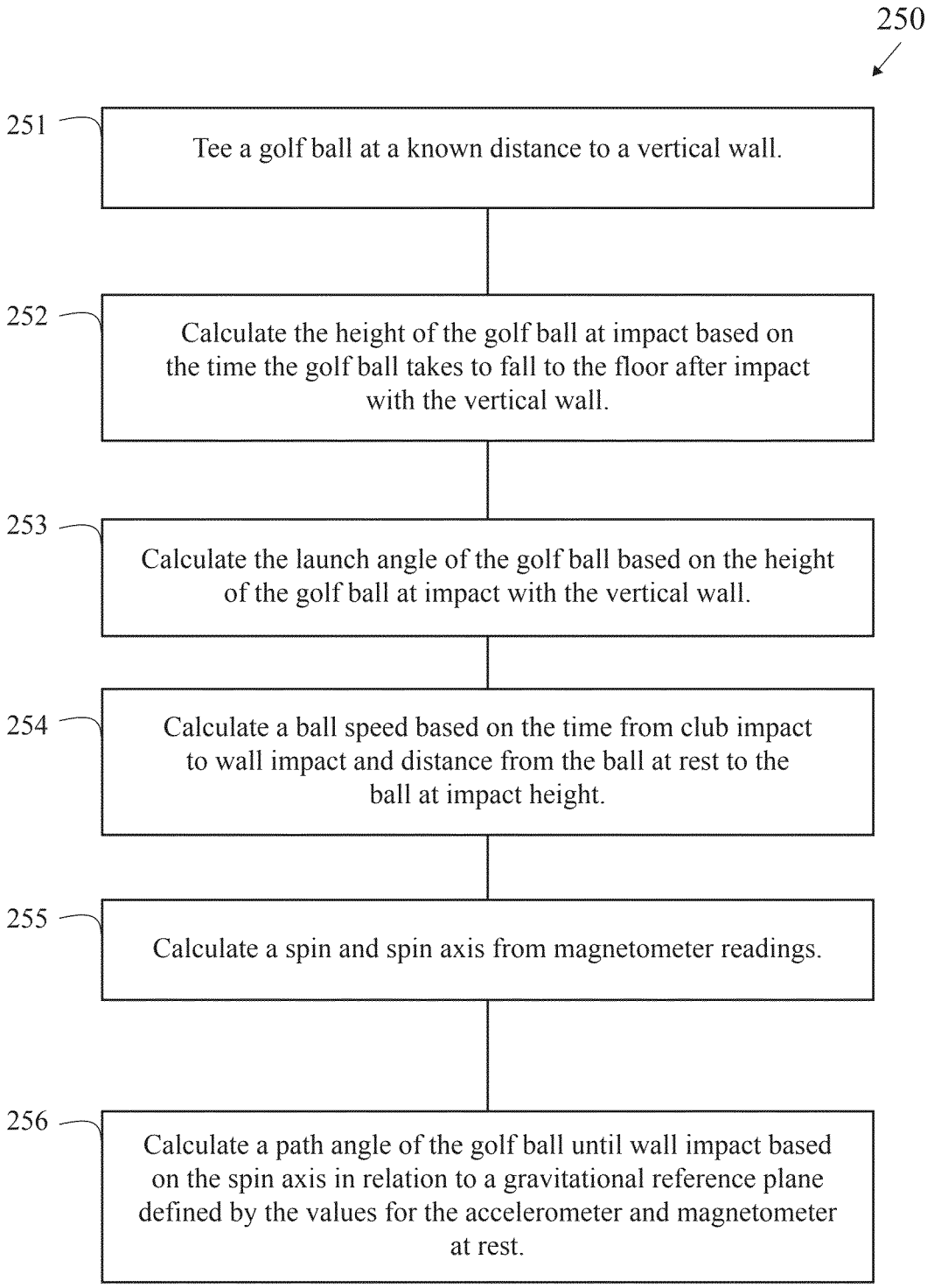
FIG. 34 is a flow chart of a method for obtaining golf ball launch parameters.

A flow chart for a method 250 for obtaining golf ball launch parameters is shown in FIG. 34. At step 251, a golf ball is teed at a known distance to a vertical wall. At step 252, the height of the golf ball at impact is calculated, based on the time the golf ball takes to fall to the floor after impact with the vertical wall. At step 253, the launch angle of the golf ball is calculated, based on the height of the golf ball at impact with the vertical wall. At step 254, a ball speed is calculated, based on the time from club impact to wall impact and on the distance from the ball at rest to the ball at impact height. At step 255, a spin and spin axis is calculated from magnetometer readings. At step 256, a path angle of the golf ball from the tee until wall impact is calculated, based on the spin axis in relation to a gravitational reference plane defined by the values for the accelerometer and magnetometer at rest.

Calculating a spin and spin axis from magnetometer readings comprises capturing a 3-axis of magnetometer data during ball flight up to wall impact; the rotations result in a sinusoidal oscillations of all 3 axis readings; the averages of these oscillations on each axis define the spin axis; and the resultant X, Y, magnetometer readings define total spin.

The golf ball 80 preferably comprises an epoxy sphere 112 comprising a body and an electronic component 125, a core layer 12 over the epoxy sphere 112, and a cover layer 16 over the outer core. The body of the epoxy sphere 112 is made of an epoxy material. The electronic component 125 of the epoxy sphere comprises an integrated circuit, a gyroscope, a magnetometer, and a BLUETOOTH low energy (BTLE) radio, and at least one battery, and is encompassed within the body of the epoxy sphere 112.

Figure 21:
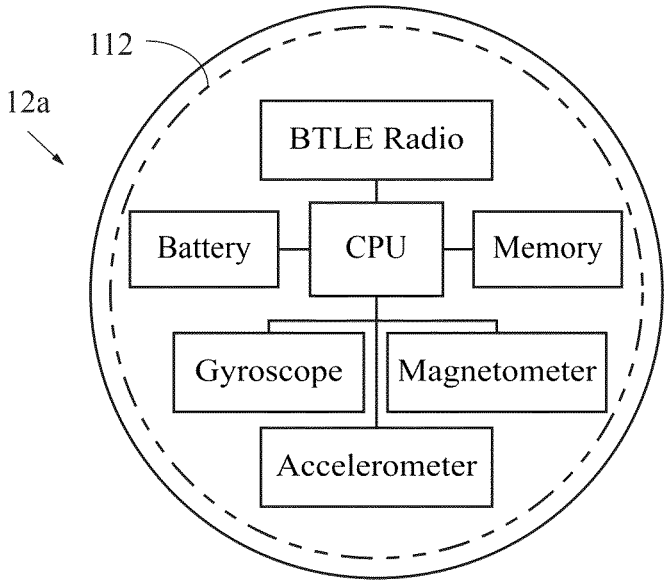
FIG. 21 is a block diagram of the internal circuitry.

FIG. 21 is a block diagram of an inner core 12*a*, showing the epoxy sphere 112 and the electronic component within the body of the sphere 112.

The BTLE radio preferably has a range of at least 700 meters.

The core layer preferably comprises polybutadiene material and a graphene material in an amount ranging from 0.1 to 5.0 weight percent of the outer core, the outer core having a flexural modulus ranging from 80 MPa to 95 MPa.

The electronic component has a width ranging from 5 to 20 mm, a height ranging from 5-20 mm and a length ranging from 5-20 mm. The epoxy sphere has a diameter ranging from 0.4 inch to 0.9 inch. Alternatively, the epoxy sphere has a diameter ranging from 0.45 inch to 0.6 inch.

The integrated circuit is flexible and is wrapped around the battery.

The integrated circuit is attached to the battery at three contact points.

The electronic component is centered in the core 12 of a golf ball 80, as shown in FIG. 32.

The integrated circuit comprises a 1 GigaHertz antenna, a microcontroller and a radiofrequency transceiver.

The integrated circuit preferably includes capacitors 221-233 and at least one inductor 214.

The magnetometer preferably operates at 85 Hertz or greater.

The electronic component preferably detects a spin of the golf ball.

Figure 24:
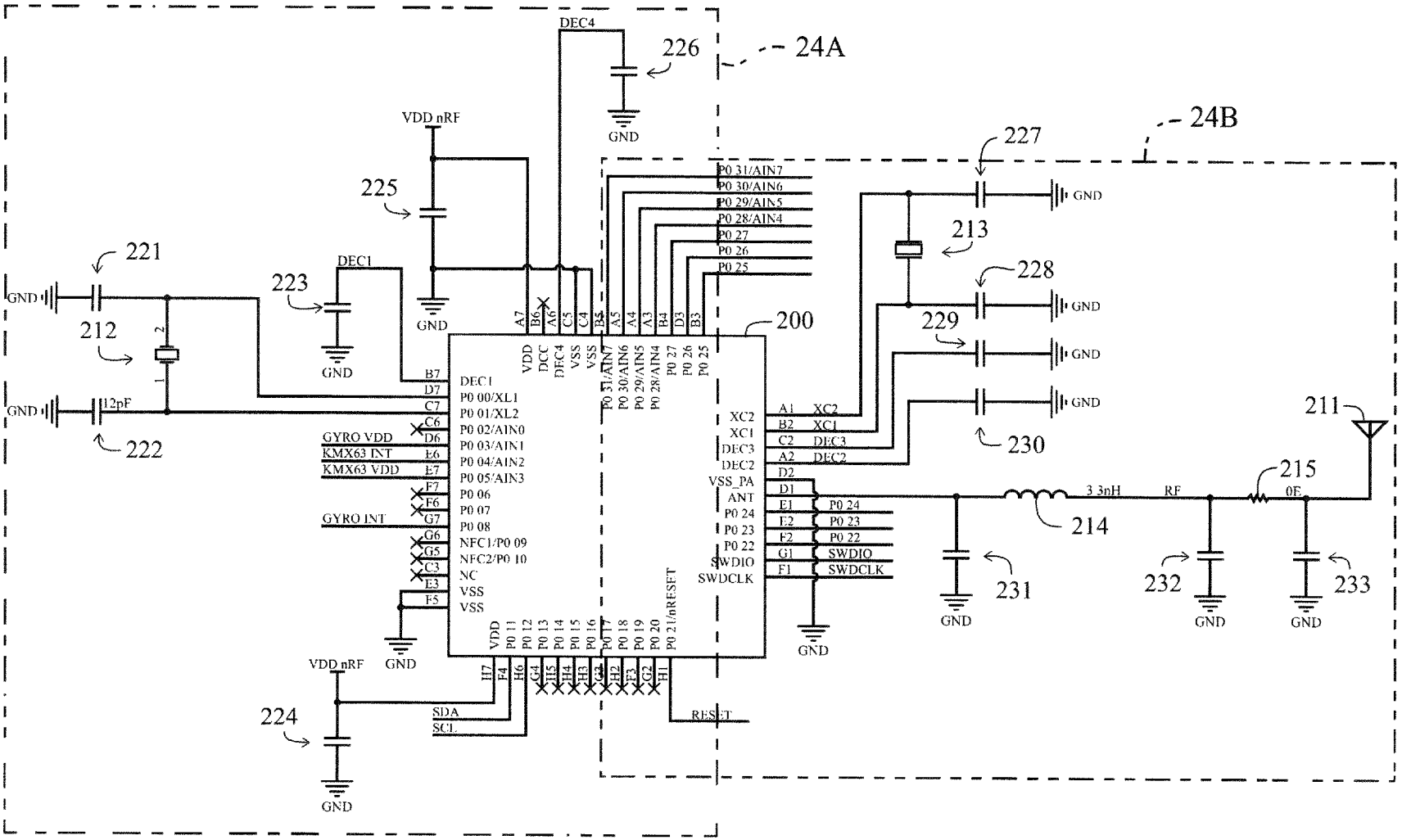
FIG. 24 is a circuit diagram.
Figure 24A:
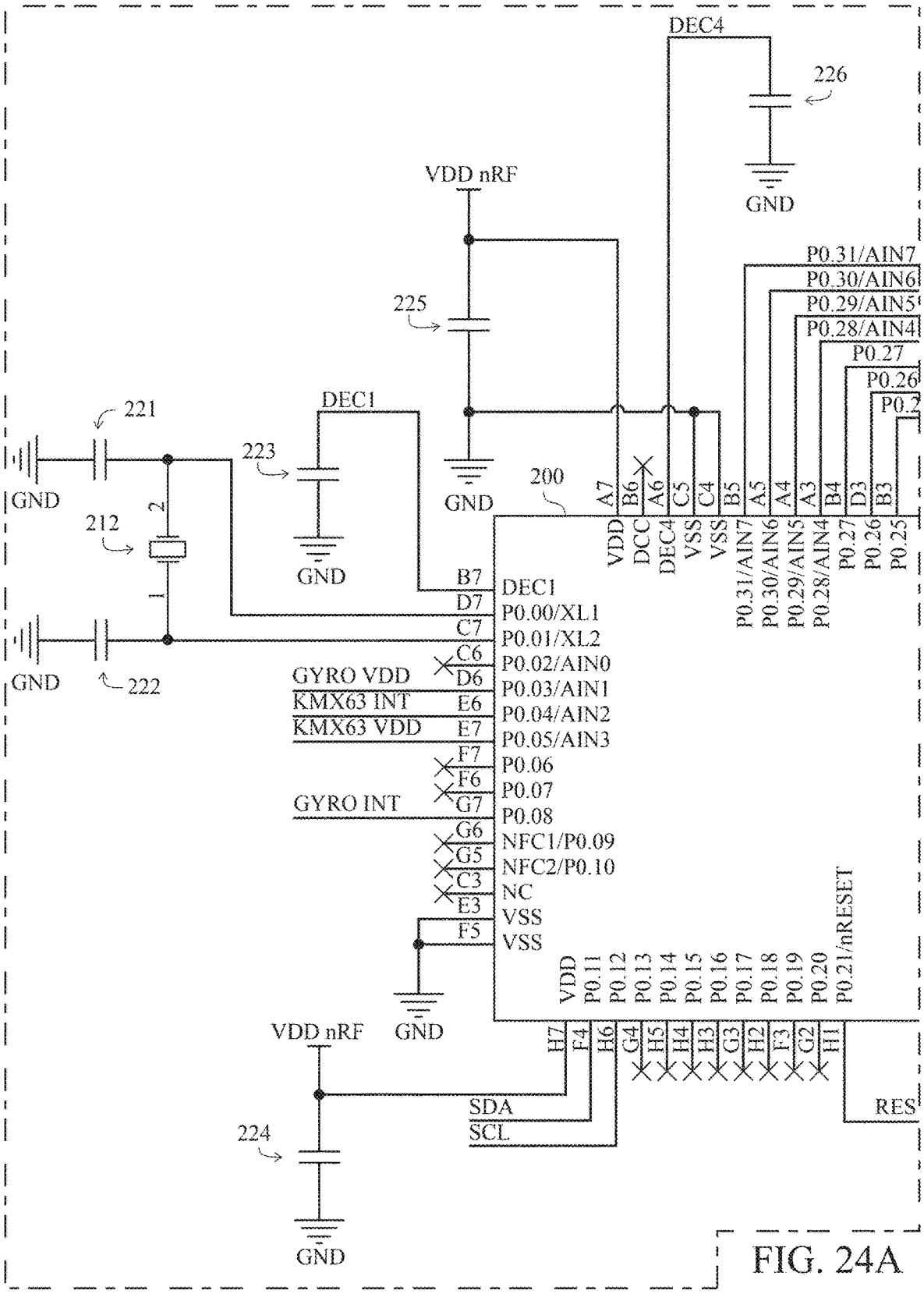
FIG. 24A is a detail of the circuit diagram of FIG. 24.
Figure 24B:
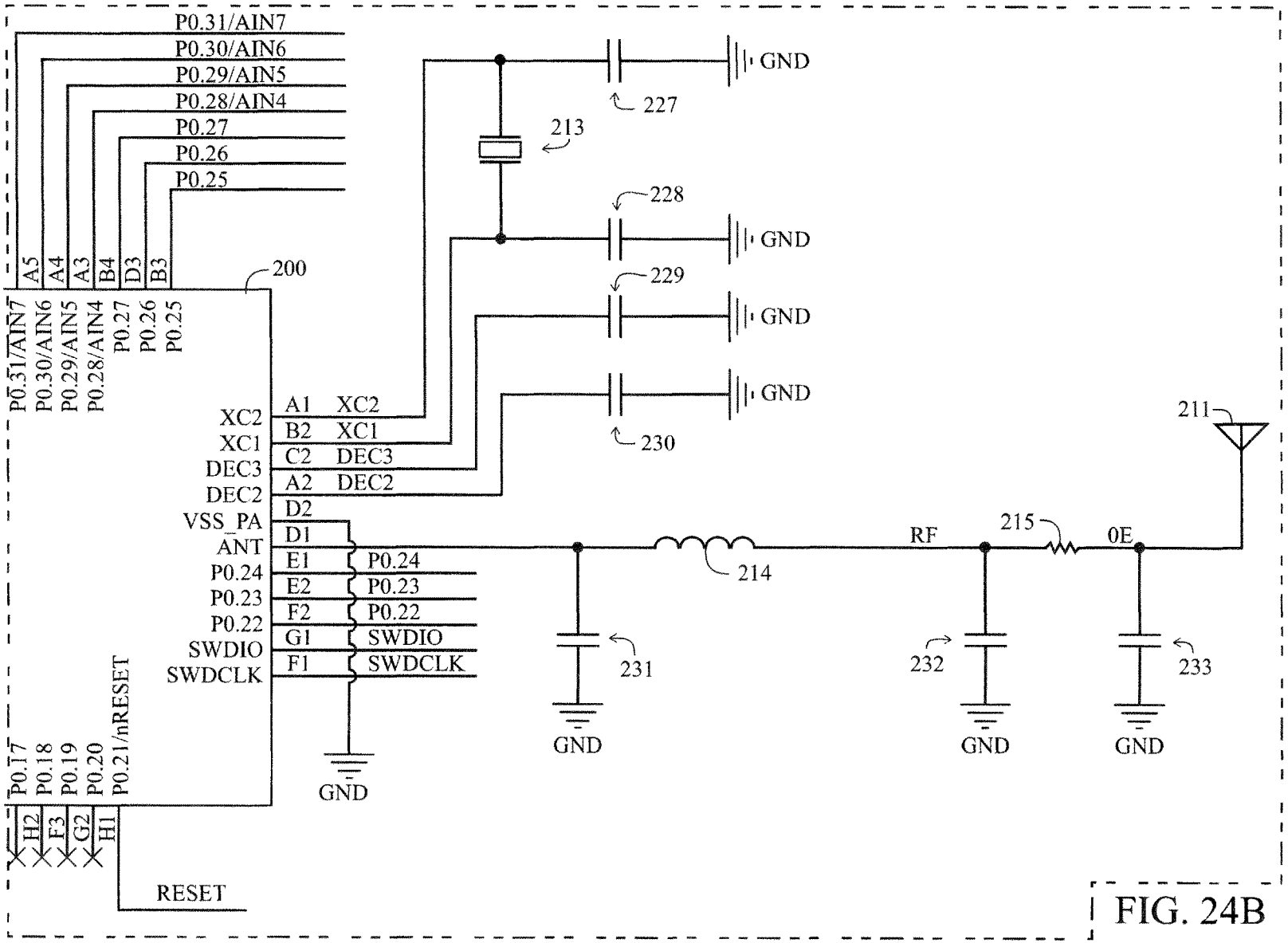
FIG. 24B is a detail of the circuit diagram of FIG. 24.

FIGS. 24 and 24A-24B are circuit diagrams of the internal circuitry of the golf ball.

Figure 24C:
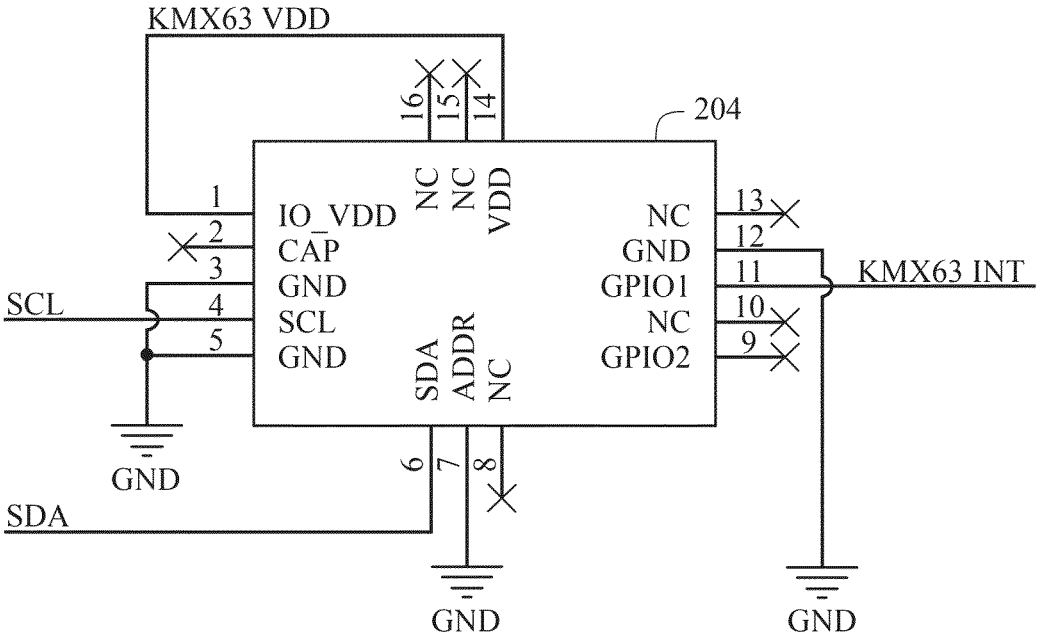
FIG. 24C is a circuit diagram.

FIG. 24C is a circuit diagram of a magnetometer/accelerometer 204, preferably a medium-G, wide bandwidth tri-axis magnetometer/tri-axis accelerometer.

Figure 24D:
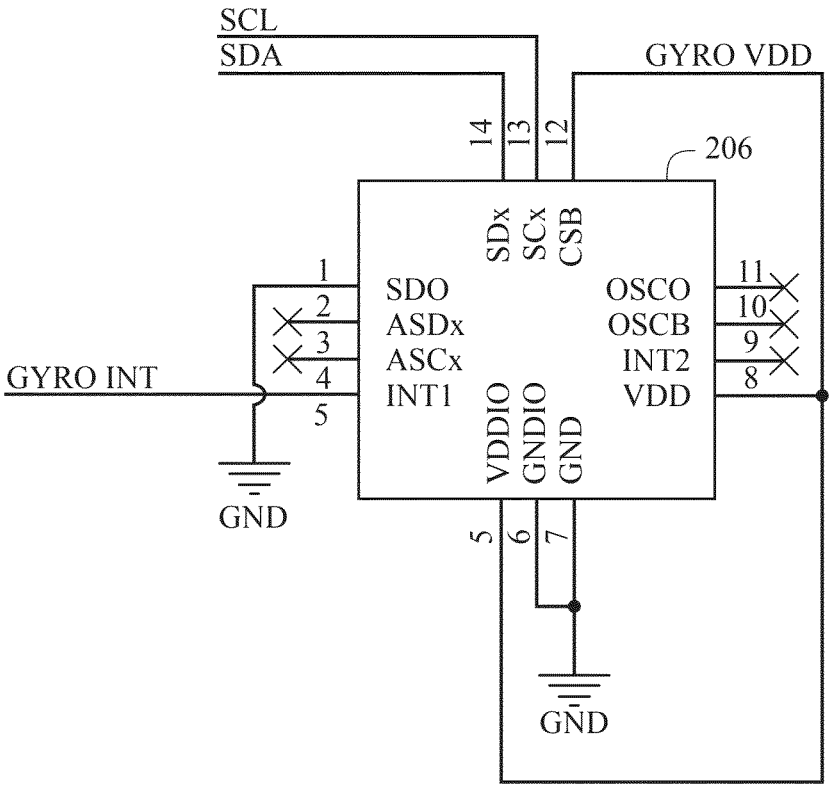
FIG. 24D is a circuit diagram.

FIG. 24D is a circuit diagram for a gyroscope 206, preferably a BOSCH SENSORTEC BMG250 gyroscope.

Figure 24E:
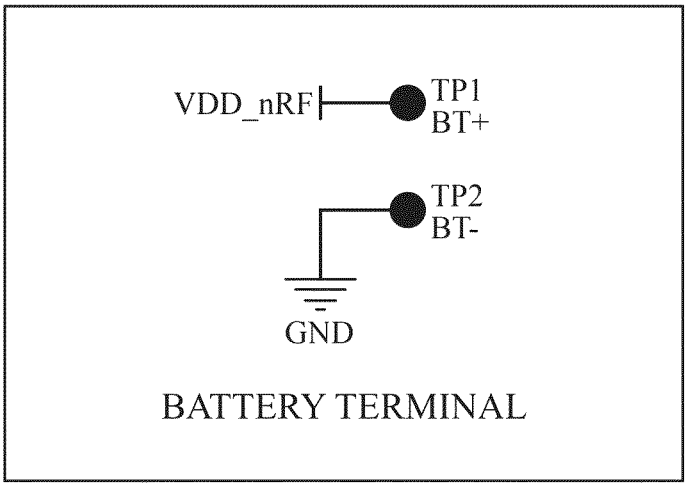
FIG. 24E is a circuit diagram.

FIG. 24E is a circuit diagram of a battery terminal.

Figure 24F:
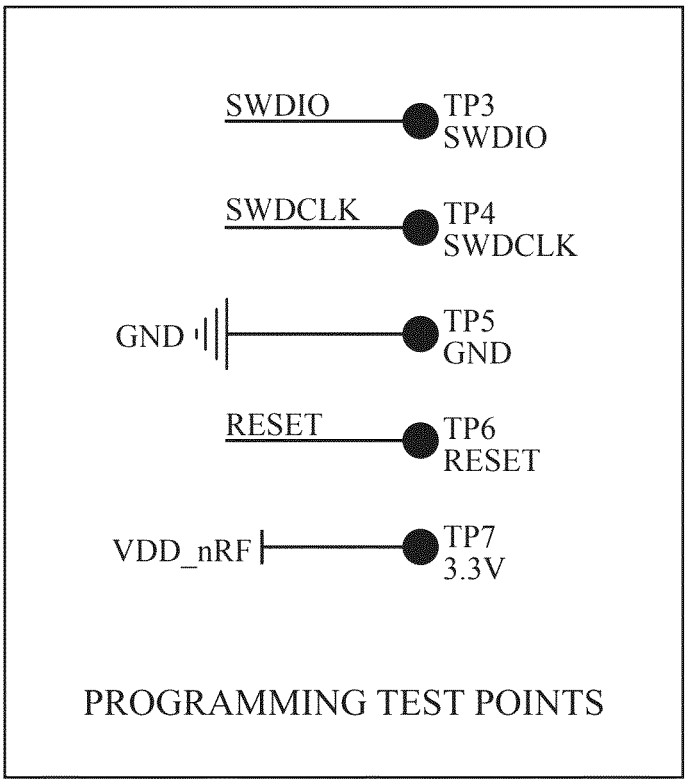
FIG. 24F is a circuit diagram.

FIG. 24F is a circuit diagram of programming test points.

Figure 25:
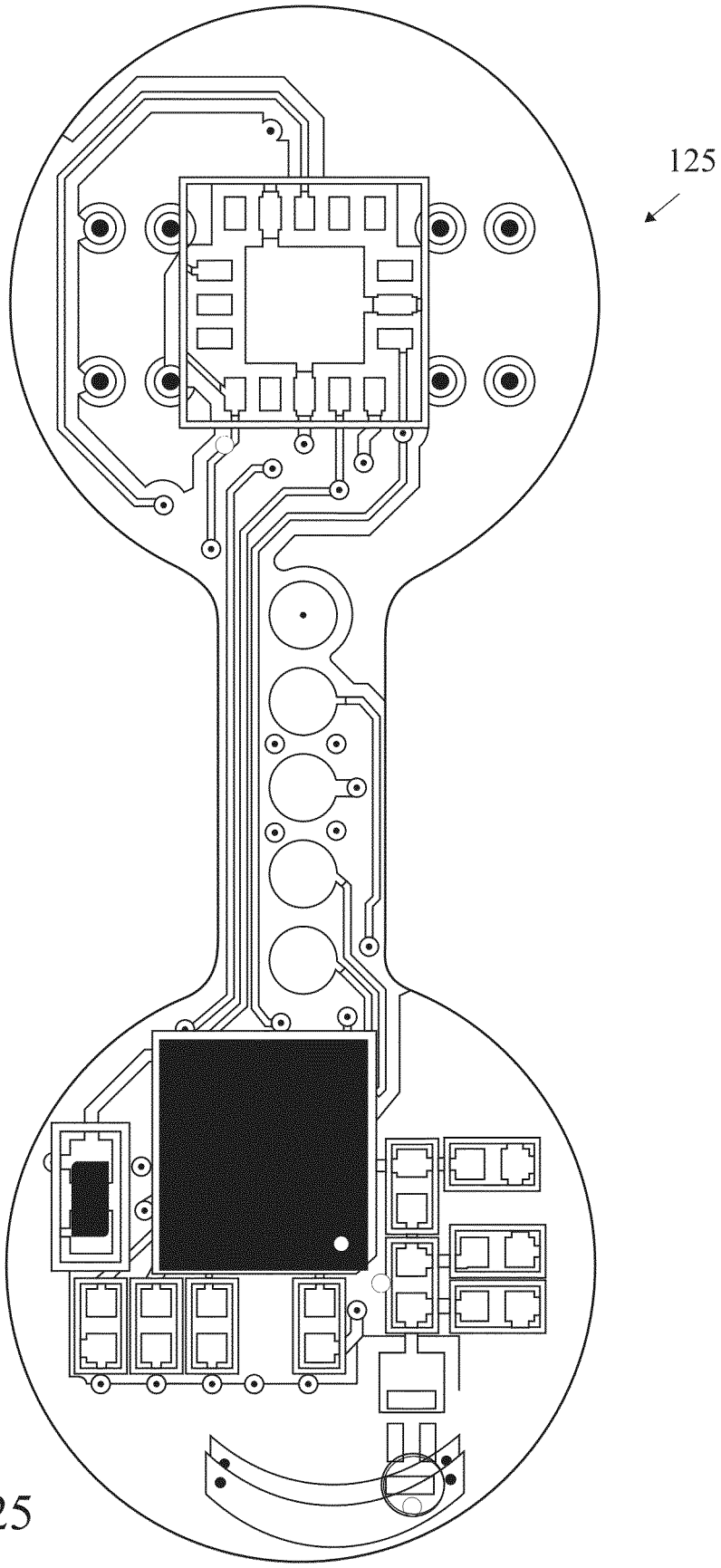
FIG. 25 is a top plan view of a flexible circuit board.
Figure 26:
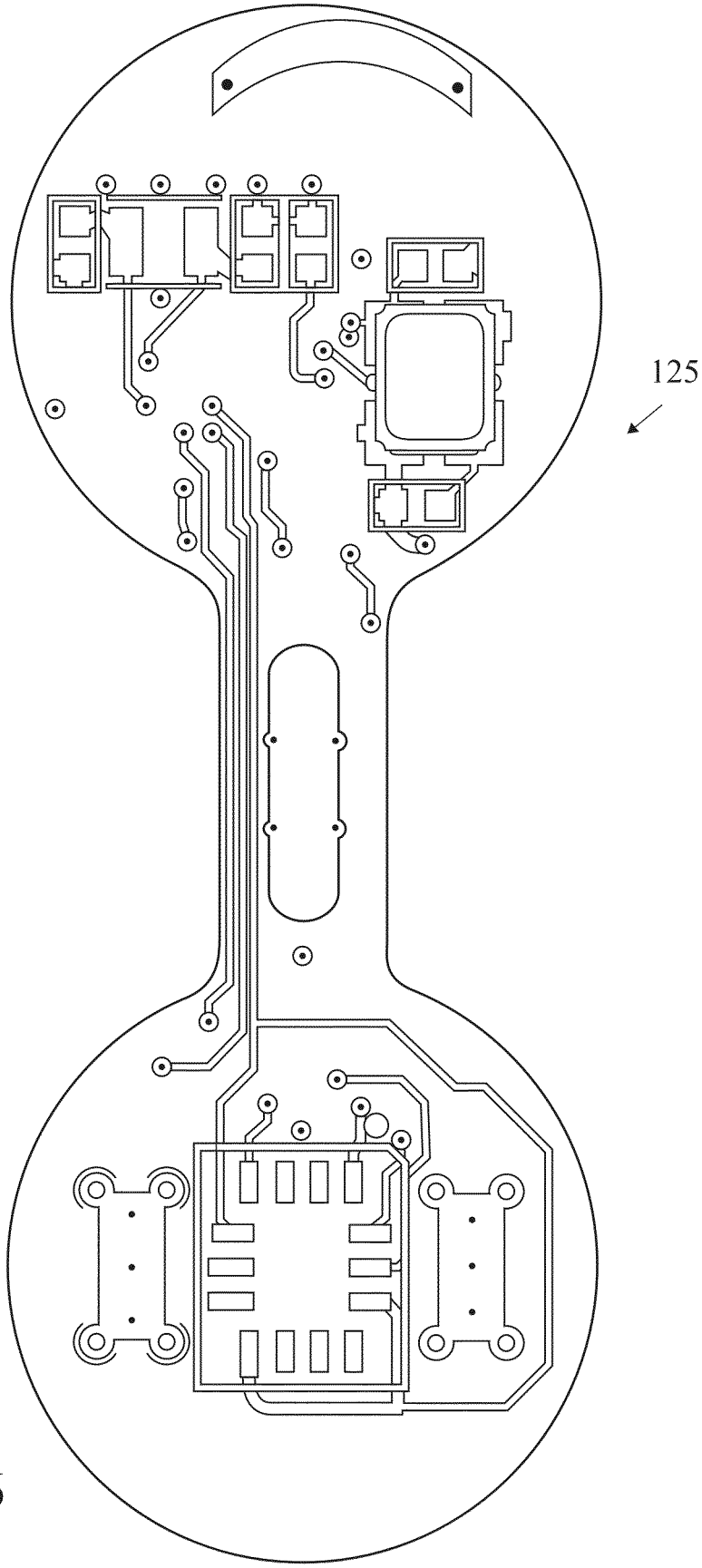
FIG. 26 is a bottom plan view of a flexible circuit board.

FIG. 25 is a top plan view and FIG. 26 is a bottom plan view of a flexible circuit board 125.

Figure 27:
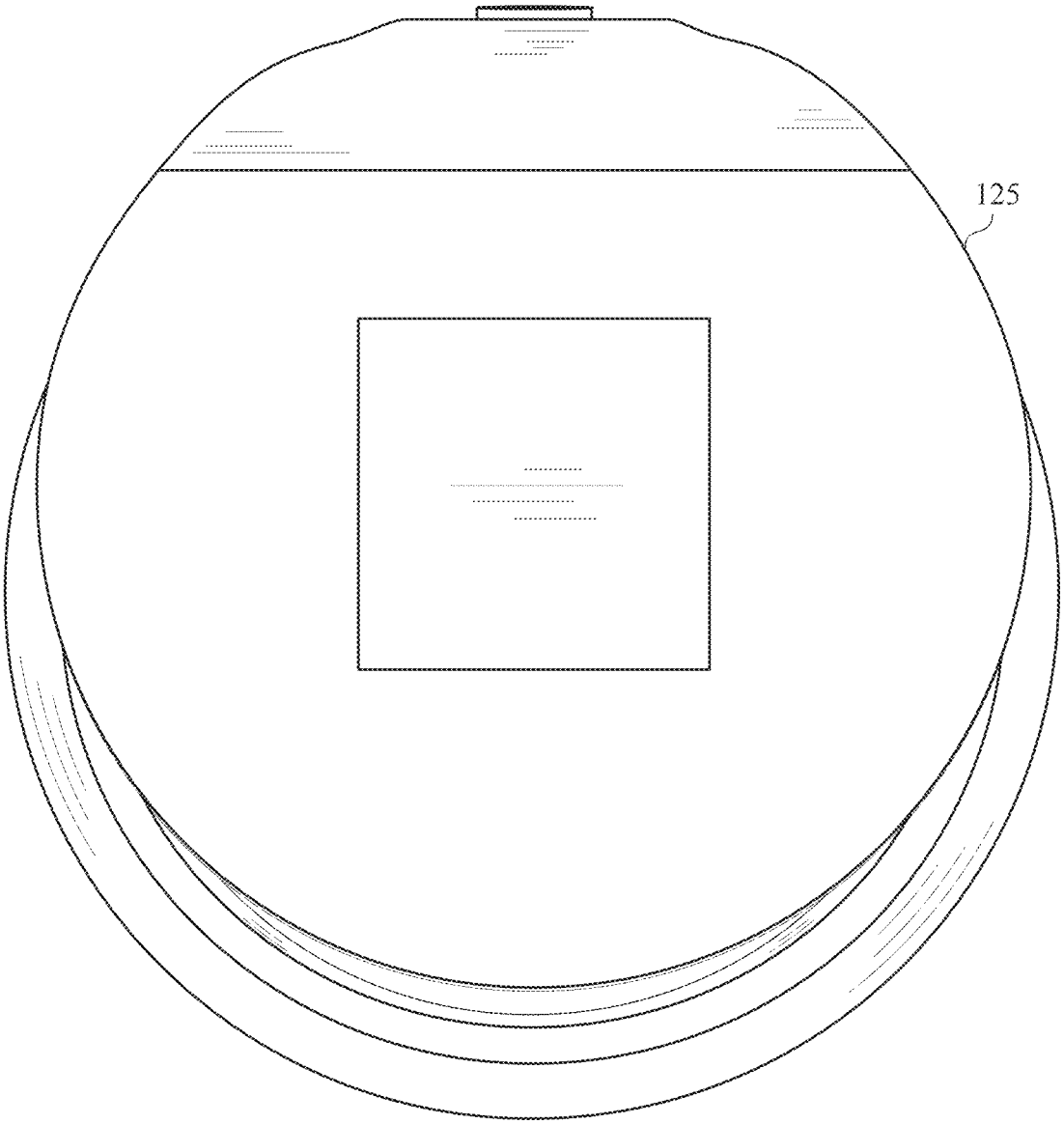
FIG. 27 is an illustration of an electronic component.

FIG. 27 is an illustration of an electronic component 125.

Figure 28:
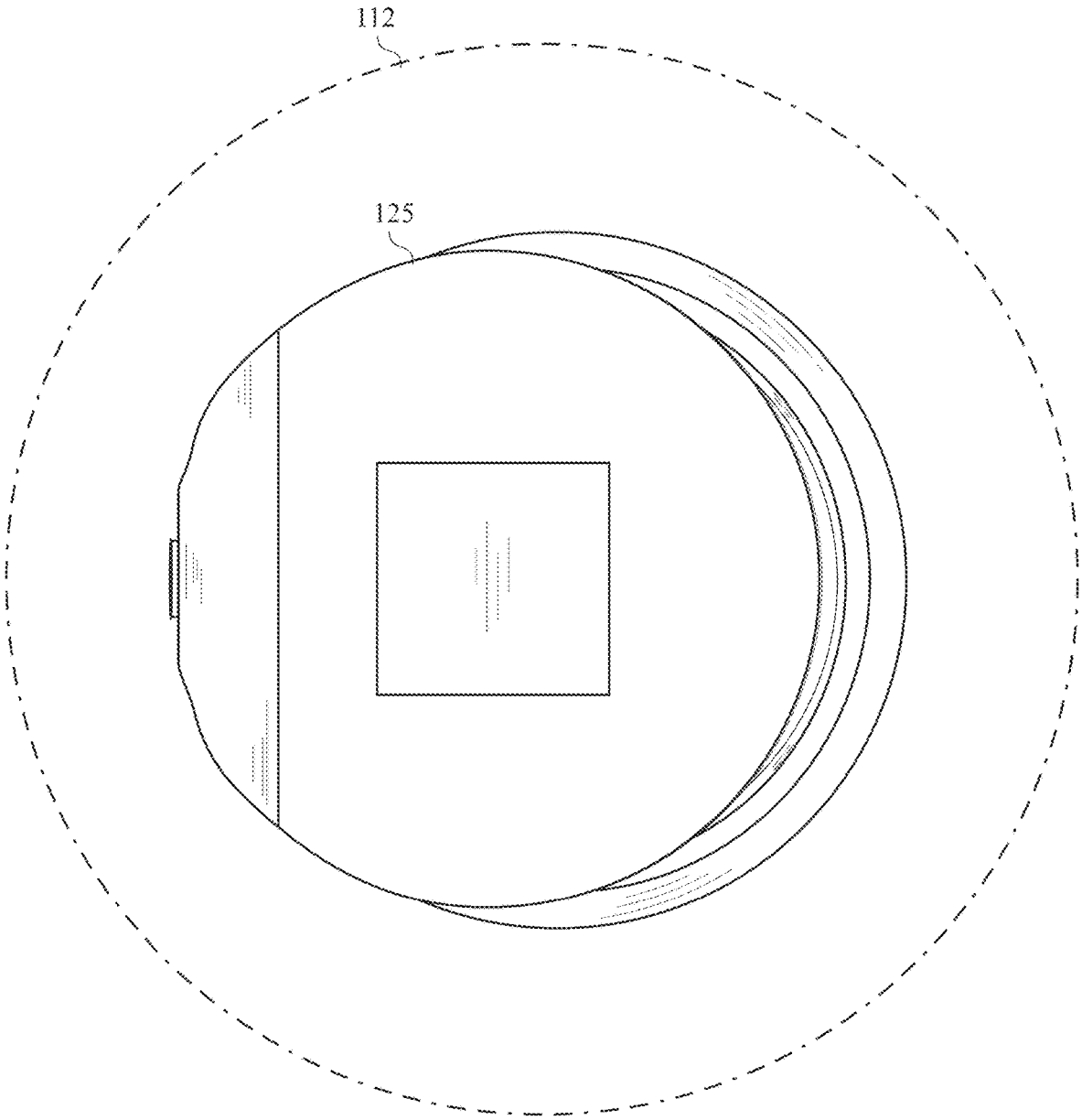
FIG. 28 is an illustration of an electronic component within an epoxy sphere for a golf ball.

FIG. 28 is an illustration of an electronic component 125 within an epoxy sphere 112 for a golf ball.

Figure 29:
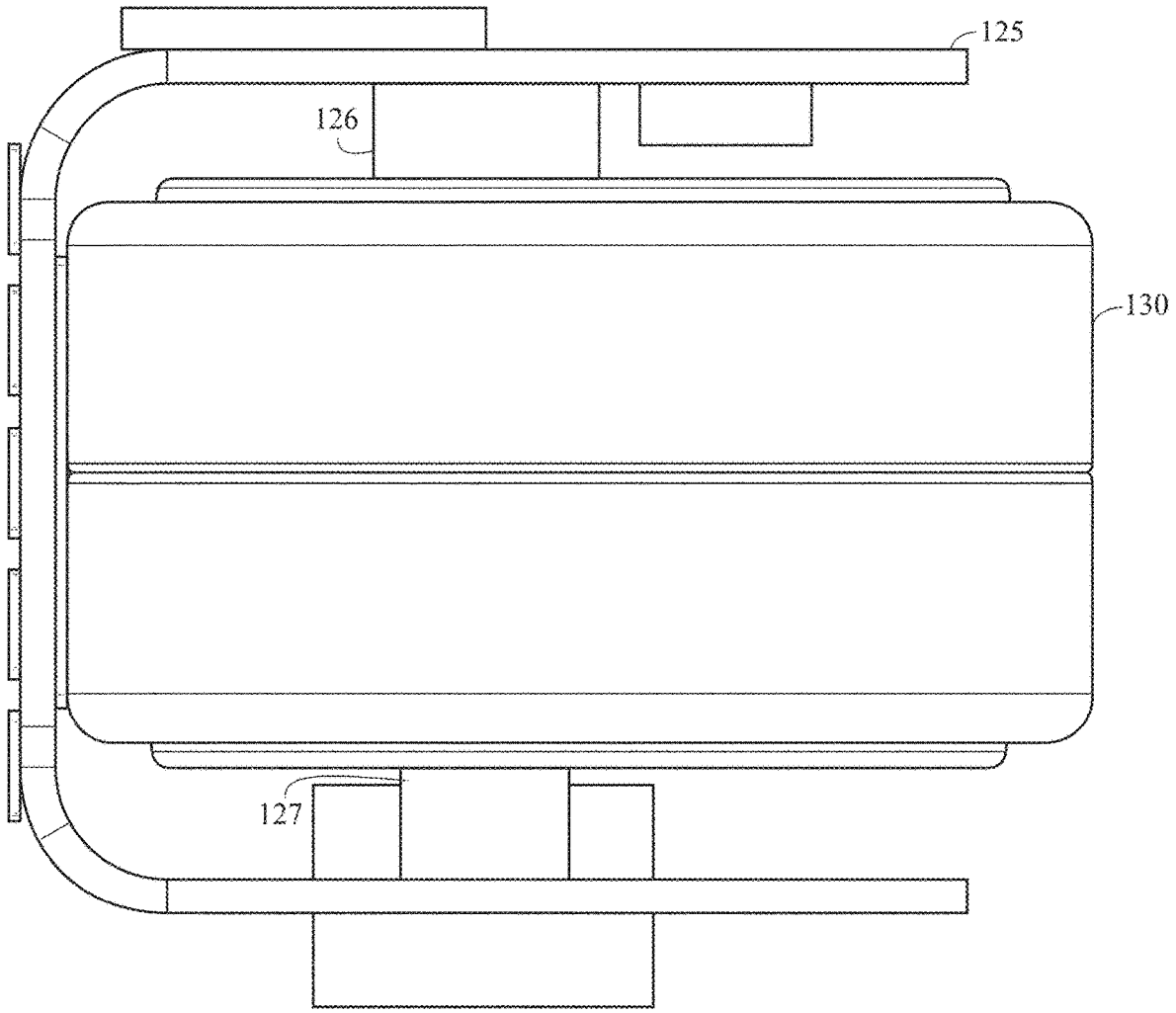
FIG. 29 is an illustration of a flexible circuit board wrapped around multiple batteries.

FIG. 29 is an illustration of a flexible circuit board 125 wrapped around multiple batteries 130 and connected to the batteries 130 by contacts 126 and 127.

Figure 30:
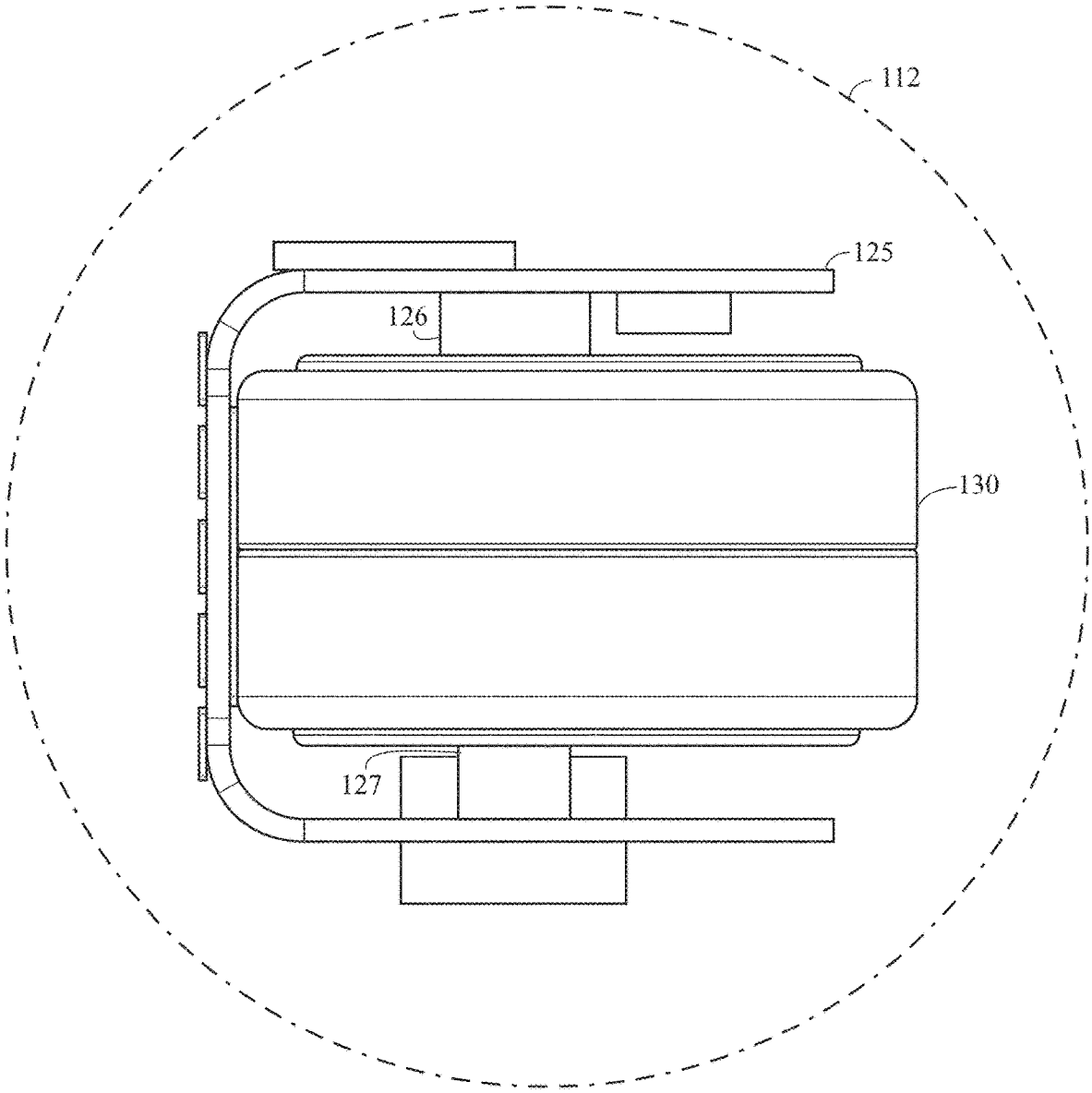
FIG. 30 is an illustration of a flexible circuit board wrapped around multiple batteries within an epoxy sphere for a golf ball.

FIG. 30 is an illustration of a flexible circuit board 125 wrapped around multiple batteries 130 within an epoxy sphere 112.

The golf ball 80 further comprises an inner mantle layer over the core layer, and an outer mantle layer over the inner mantle layer. The inner mantle layer having a thickness ranging from 0.03 inch to 0.09 inch, is composed of an ionomer material, the inner mantle layer material has a plaque Shore D hardness ranging from 34 to 55. The outer mantle layer has a thickness ranging from 0.025 inch to 0.050 inch. The cover layer is disposed over the outer mantle layer, the cover layer has a thickness ranging from 0.025 inch to 0.040 inch. The cover layer has a lower Shore D hardness than the outer mantle layer, the outer mantle layer has a higher Shore D hardness than the inner mantle layer, and the core layer has a higher Shore D hardness than the inner mantle layer.

Alternatively, the inner mantle layer has a thickness ranging from 0.03 inch to 0.09 inch, the inner mantle layer material has a plaque Shore D hardness ranging from 30 to 50. The outer mantle layer has a thickness ranging from 0.025 inch to 0.070 inch, the outer mantle layer material has a plaque Shore D hardness ranging from 50 to 71. The inner mantle is thicker than the outer mantle, and the outer mantle is harder than the inner mantle. The cover layer has a thickness ranging from 0.025 inch to 0.050 inch, with a Shore D hardness less than the hardness of the outer mantle layer, the outer mantle layer has a higher Shore D hardness than the inner mantle layer, the core layer has a higher Shore D hardness than the inner mantle layer.

Alternatively, the inner mantle has a thickness ranging from 0.070 inch to 0.090 inch, composed of an ionomer material, the inner mantle layer material has a plaque Shore D hardness ranging from 36 to 44. The outer mantle layer has a thickness ranging from 0.025 inch to 0.040 inch, is composed of an ionomer material, and has a plaque Shore D hardness ranging from 65 to 71. The cover layer has a thickness ranging from 0.025 inch to 0.040 inch. The cover layer has a lower Shore D hardness than the outer mantle layer, the outer mantle layer has a higher Shore D hardness than the inner mantle layer, the core layer has a higher Shore D hardness than the inner mantle layer.

The core comprising an inner core and an outer core preferably has a compression value ranging from 40 to 55.

Alternatively, the golf ball 80 further comprises an inner mantle layer over the center core, a first center mantle layer over the inner mantle layer, a second center mantle layer over the second center mantle layer, and an outer mantle layer over the second center mantle layer. The inner mantle layer has a thickness ranging from 0.030 inch to 0.050 inch, the inner mantle layer material having a plaque Shore D hardness ranging from 30 to 40, and is composed of an ionomer material. The first center mantle layer has a thickness ranging from 0.030 inch to 0.050 inch, the first center mantle layer material having a plaque Shore D hardness ranging from 40 to 55, and is composed of a fully neutralized polymer material. The second center mantle layer has a thickness ranging from 0.030 inch to 0.050 inch, the second center mantle layer material having a plaque Shore D hardness ranging from 45 to 55, and is composed of a fully neutralized polymer material. The outer mantle layer has a thickness ranging from 0.030 inch to 0.050 inch, is composed of a blend of ionomers, the outer mantle layer material having a plaque Shore D hardness ranging from 60 to 75. The cover layer is over the outer mantle layer and has a thickness ranging from 0.025 inch to 0.040 inch.

The outer core preferably has a tensile modulus ranging from 8 MPa to 10 MPa.

Figure 20:
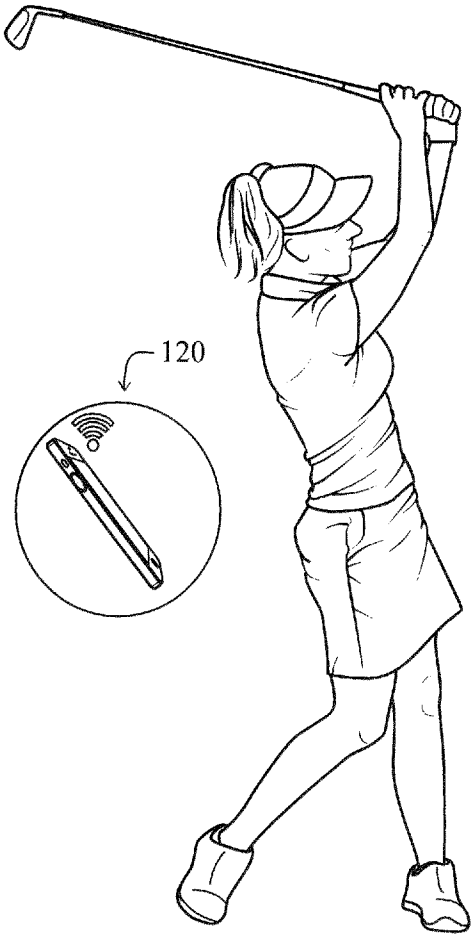
FIG. 20 is an illustration of a golfer hitting a golf ball with internal circuitry according to the present invention therein.

FIG. 20 is an illustration of a golfer hitting a golf ball 10 with internal circuitry, which measures the spin of the golf ball 10 in flight. A mobile device 120, such as a mobile phone, receives a BLUETOOTH low energy wireless communication transmission from the golf ball 10.

Figure 22:
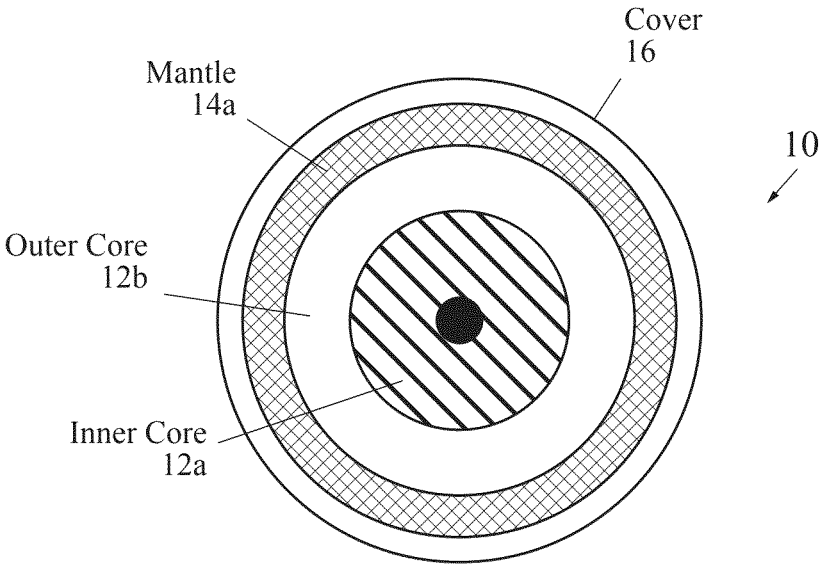
FIG. 22 is a cross-sectional view of a golf ball with an internal circuitry therein.

FIG. 22 is a cross-sectional view of a golf ball 10 with an internal circuitry in an inner core 12*a*.

Figure 23:
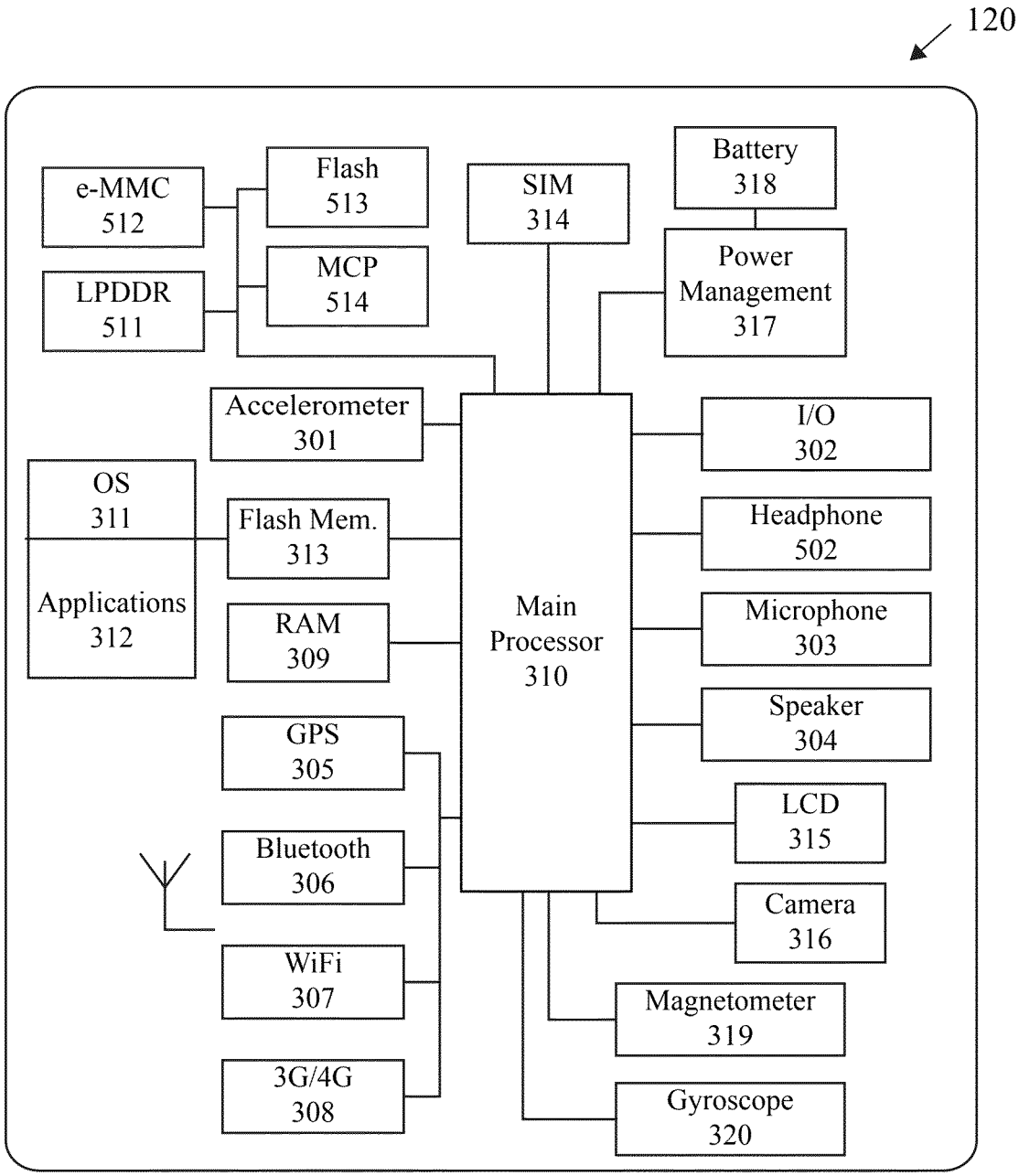
FIG. 23 is a block diagram of components of a mobile device.

FIG. 23 is a block diagram of components of a mobile device 120. The mobile device 120 preferably comprises an accelerometer 301, an input/output module 302, a microphone 303, a speaker 304, a GPS 305, a BLUETOOTH transceiver 306, a WiFi transceiver 307, a 3G/4G transceiver 308, a RAM memory 309, a main processor 310, an operating system (OS) module 311, an applications module 312, a flash memory 313, a SIM card 314, a LCD display 315, a camera 316, a power management module 317, a battery 318, a magnetometer 319, a gyroscope 320, a LPDDR module 511, a e-MMC module 512, a flash module 513, and a MCP module 514.

FIGS. 1, 3, 4 and 5 illustrate a five piece golf ball 10 comprising an inner core 12*a*, an outer core 12*b*, an inner mantle 14*a*, an outer mantle 14*b*, and a cover 16, with an internal circuitry comprising at least a BLUETOOTH Low Energy radio ($5^{th}$ generation), a processor, a magnetometer, an accelerometer, and a battery. The internal circuit may also have a memory.

Figure 1:
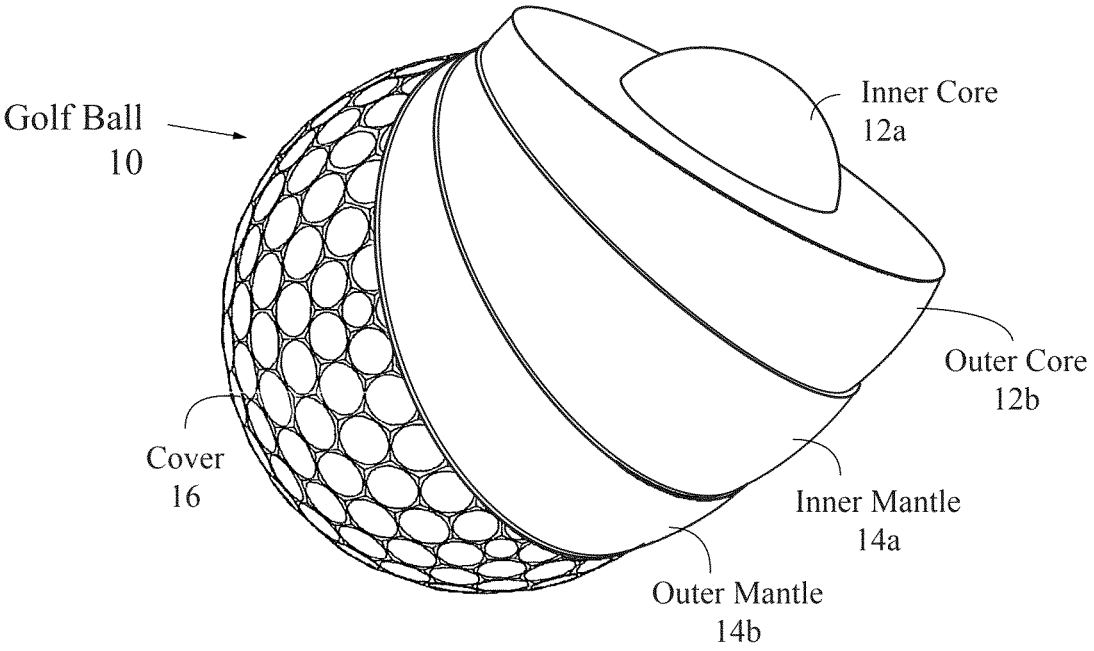
FIG. 1 is an exploded partial cut-away view of a golf ball.
Figure 2:
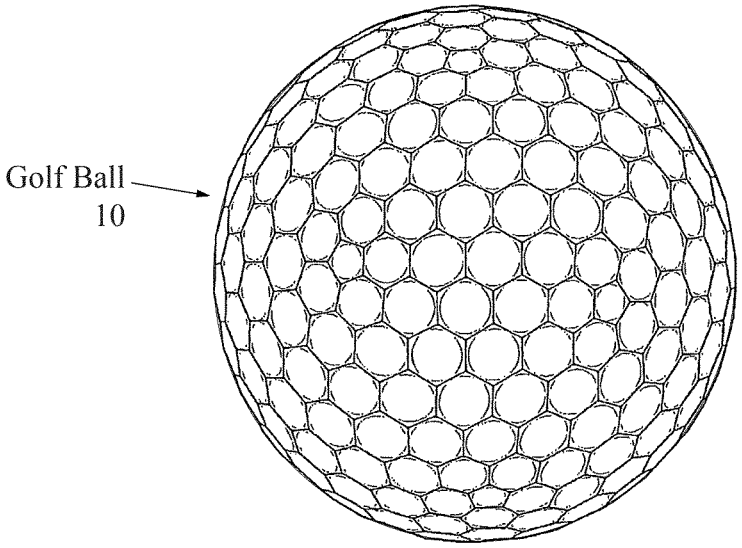
FIG. 2 is top perspective view of a golf ball.
Figure 3:
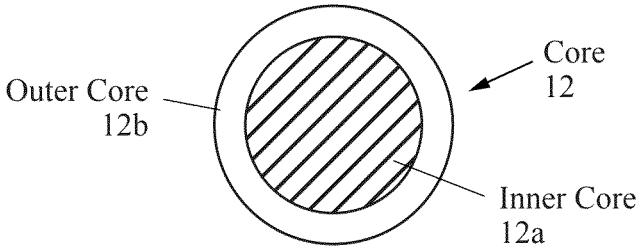
FIG. 3 is a cross-sectional view of a core component of a golf ball.
Figure 4:
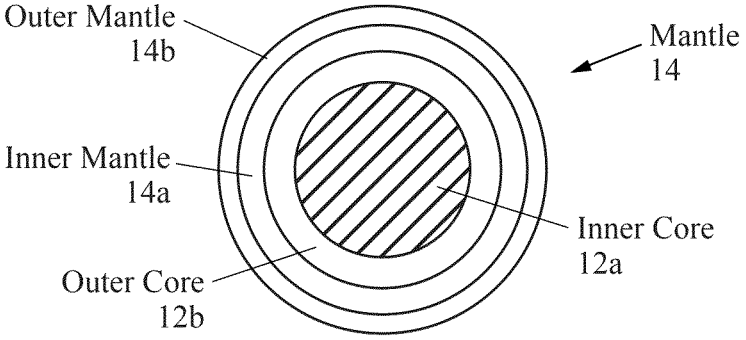
FIG. 4 is a cross-sectional view of a core component and a mantle component of a golf ball.

FIG. 2 illustrates a golf ball.

Figure 5:
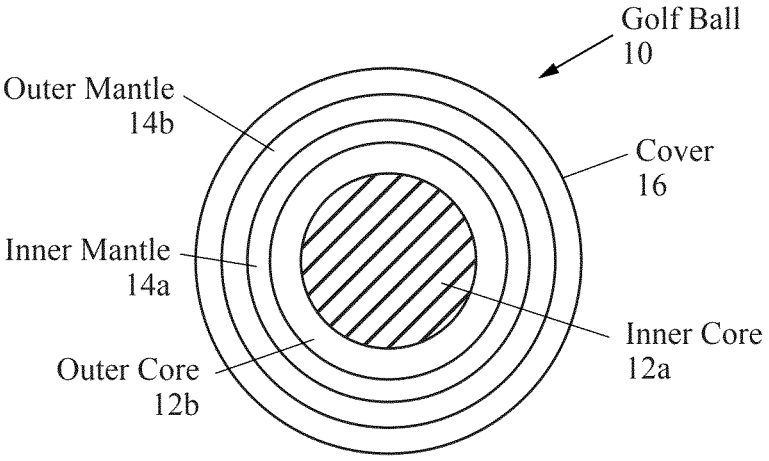
FIG. 5 is a cross-sectional view of an inner core layer, an outer core layer, an inner mantle layer, an outer mantle layer and a cover layer of a golf ball.
Figure 5A:
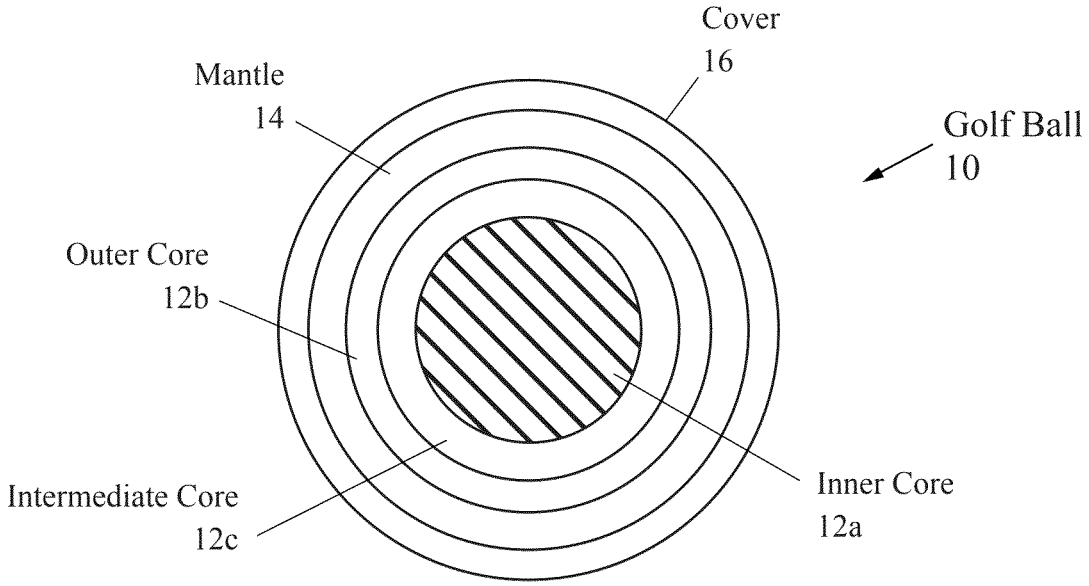
FIG. 5A is a cross-sectional view of an inner core layer, an intermediate core layer, an outer core layer, a mantle layer and a cover layer of a golf ball.

FIG. 5A illustrates a five piece golf ball 10 comprising an inner core 12*a*, an intermediate core 12*c*, an outer core 12*b*, a mantle 14, and a cover 16.

Figure 8:
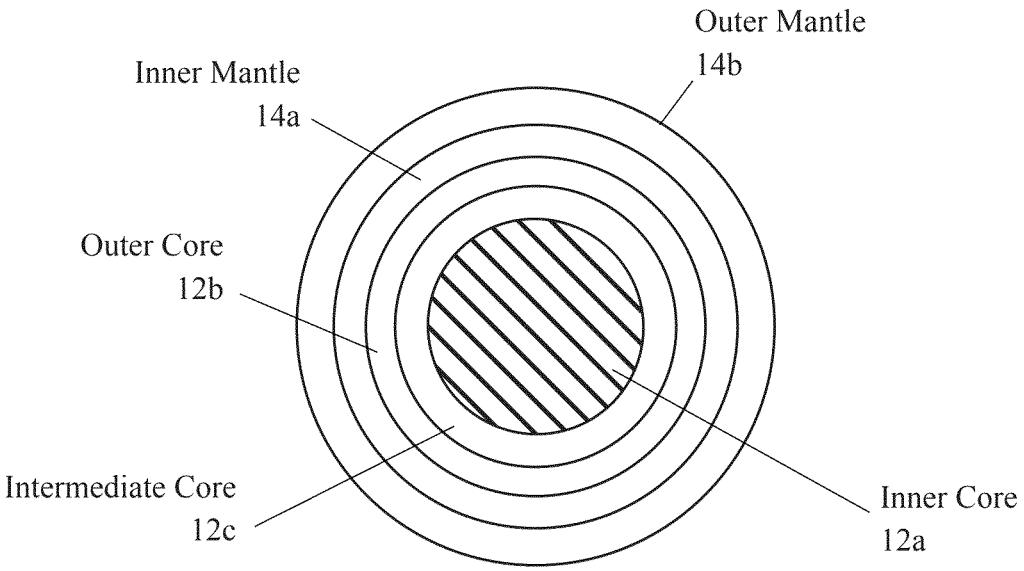
FIG. 8 is a cross-sectional view of a core component and a mantle component of a golf ball.
Figure 9:
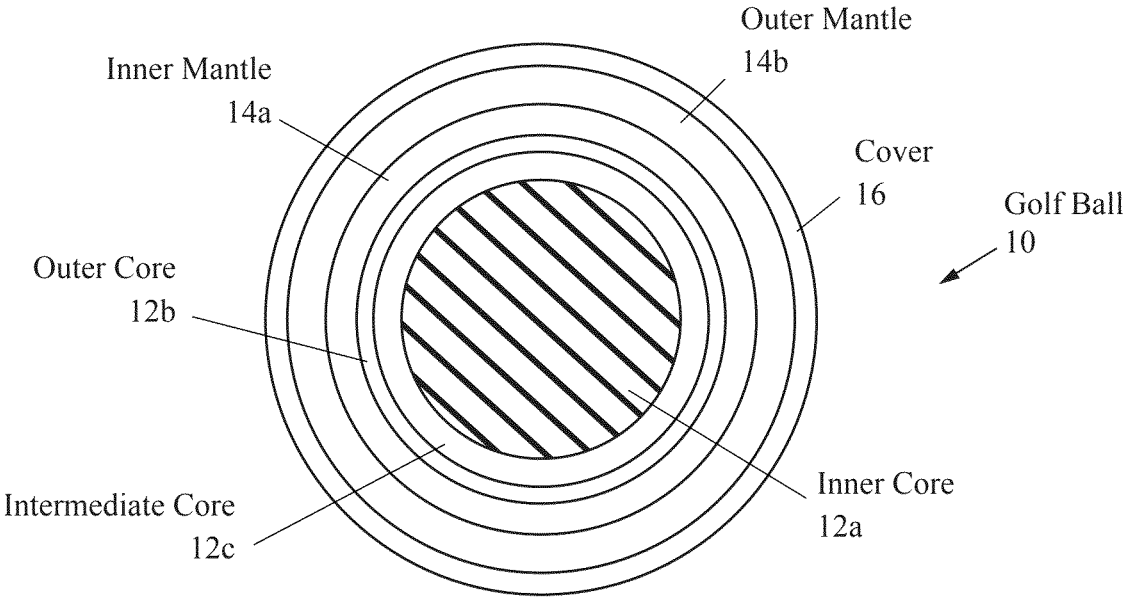
FIG. 9 is a cross-sectional view of a core component, the mantle component and a cover layer of a golf ball.

FIGS. 8 and 9 illustrate a six piece golf ball 10 comprising an inner core 12*a*, an intermediate core 12*c*, an outer core 12*b*, an inner mantle 14*a*, an outer mantle 14*b*, and a cover 16, with an internal circuitry comprising at least a BLUETOOTH Low Energy radio ($5^{th}$ generation), a processor, a magnetometer, an accelerometer, and a battery. The internal circuit may also have a memory.

Figure 10:
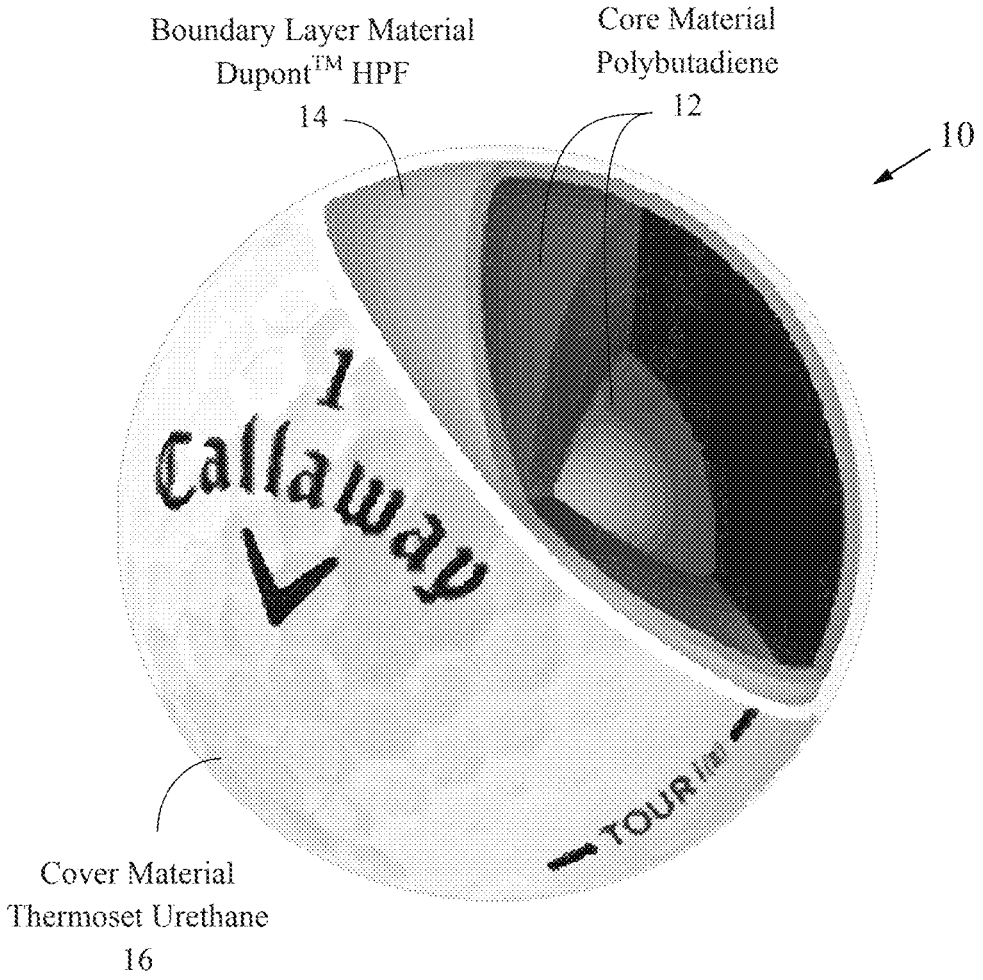
FIG. 10 is an exploded partial cut-away view of a four-piece golf ball.

FIG. 10 illustrates a four piece golf ball comprising a dual core 12, a boundary layer 14 and a cover 16, with an internal circuitry comprising at least a BLUETOOTH Low Energy radio ($5^{th}$ generation), a processor, a magnetometer, an accelerometer, and a battery. The internal circuit may also have a memory.

Figure 11:
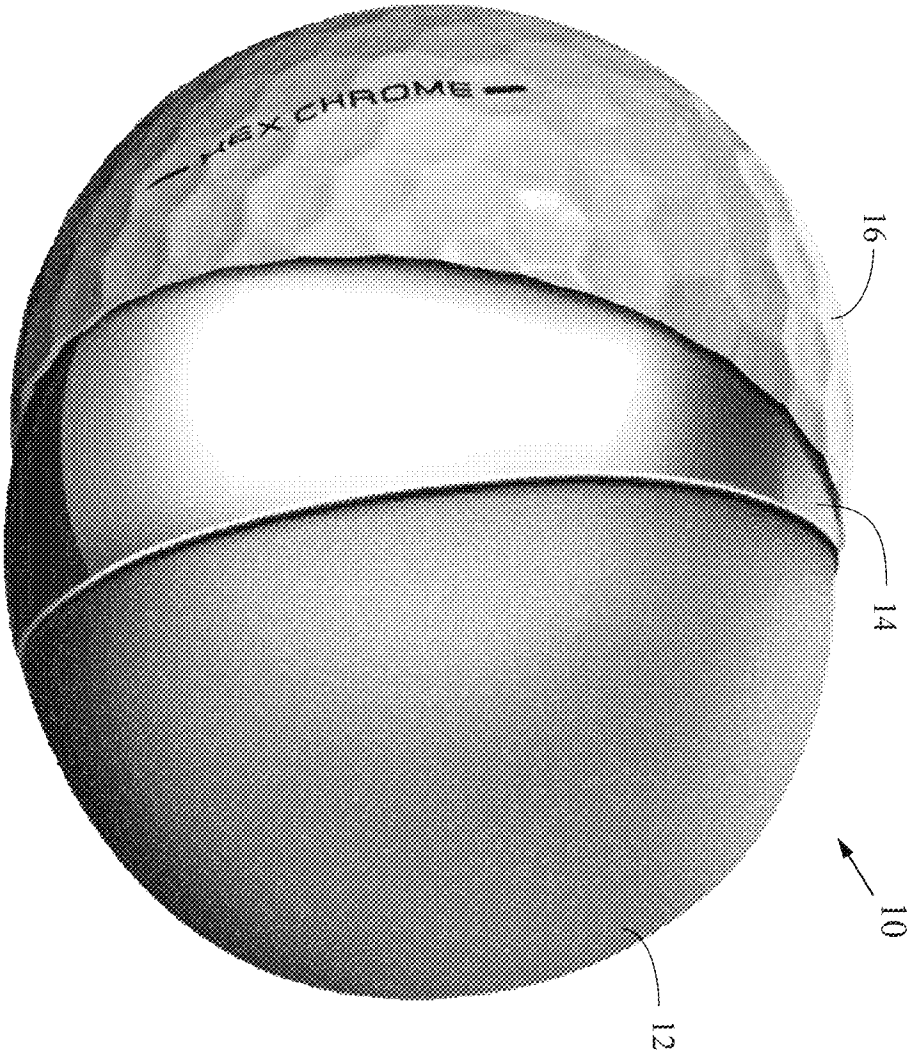
FIG. 11 is an exploded partial cut-away view of a three-piece golf ball.

FIG. 11 illustrates a three piece golf ball comprising a core 12, a boundary layer 14 and a cover 16, with an internal circuitry comprising at least a BLUETOOTH Low Energy radio ($5^{th}$ generation), a processor, a magnetometer, an accelerometer, and a battery. The internal circuit may also have a memory.

Figure 12:
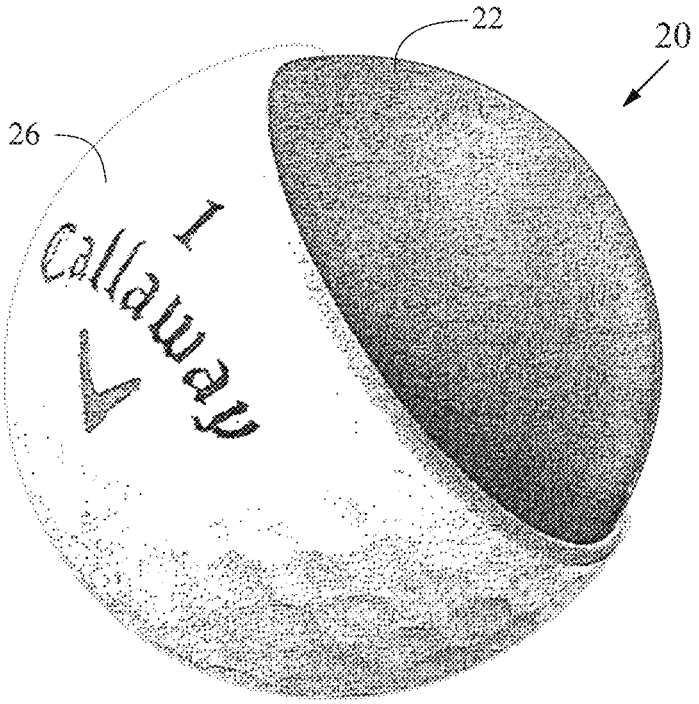
FIG. 12 is an exploded partial cut-away view of a two-piece golf ball.
Figure 13:
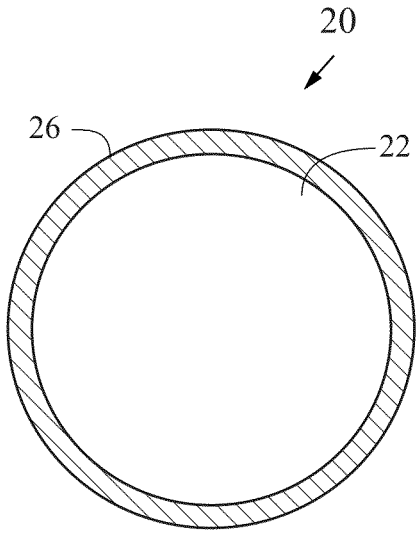
FIG. 13 is a cross-sectional view of a two-piece golf ball.

FIGS. 12 and 13 illustrate a two piece golf ball 20 with a core 22 and a cover 26 formed of a sprayed polyurea with a thickness ranging from 0.010 inch to 0.040 inch.

Figure 14:
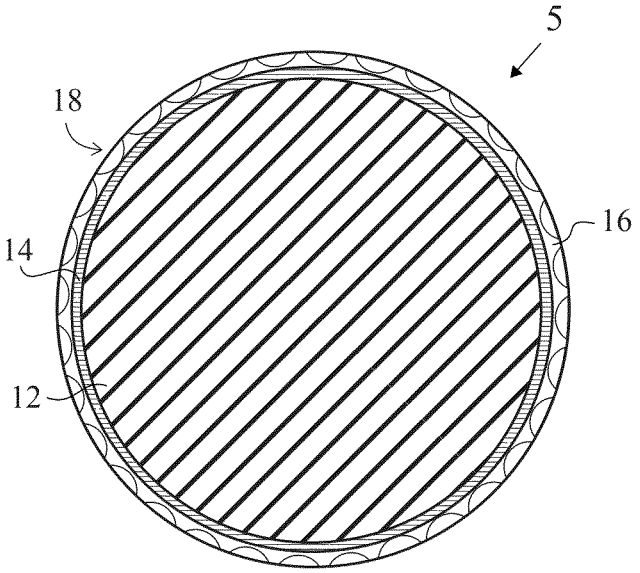
FIG. 14 is a cross-sectional view of a three-piece golf ball.
Figure 15:
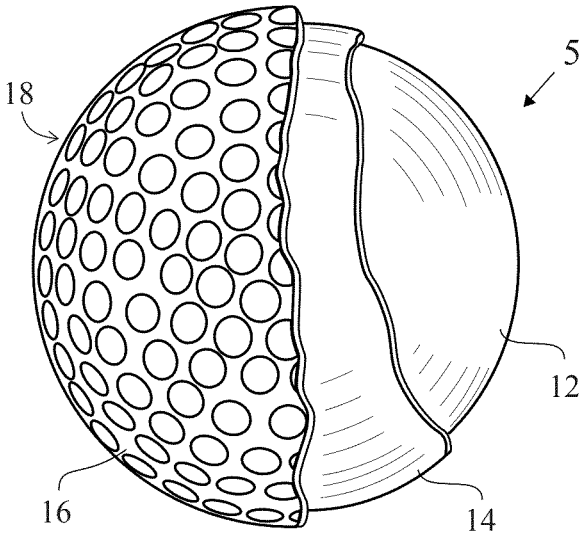
FIG. 15 is an exploded partial cut-away view of a three-piece golf ball.

FIGS. 14 and 15 illustrate a three-piece golf ball 5 comprising a core 12, a mantle layer 14 and a cover 16 with dimples 18, with an internal circuitry comprising at least a BLUETOOTH Low Energy radio ($5^{th}$ generation), a processor, a magnetometer, an accelerometer, and a battery. The internal circuit may also have a memory.

Figure 16:
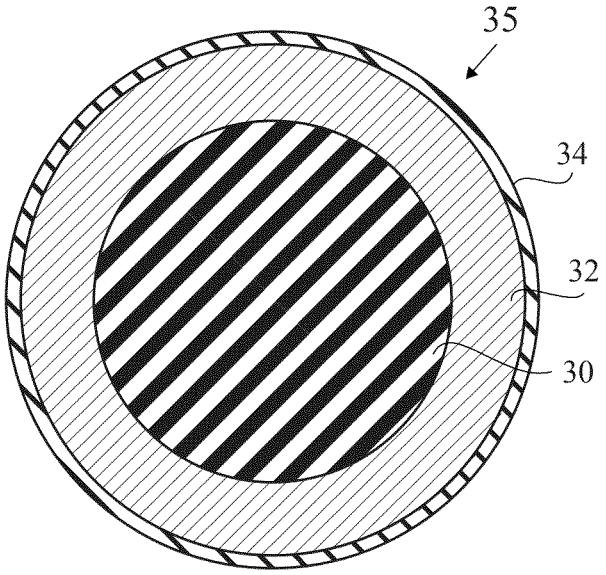
FIG. 16 is a cross-sectional view of a three-piece golf ball with a dual core and a cover.

FIG. 16 illustrates a dual core three piece golf ball 35 comprising an inner core 30, and outer core 32 and a cover 34, with an internal circuitry comprising at least a BLUETOOTH Low Energy radio ($5^{th}$ generation), a processor, a magnetometer, an accelerometer, and a battery. The internal circuit may also have a memory.

Figure 17:
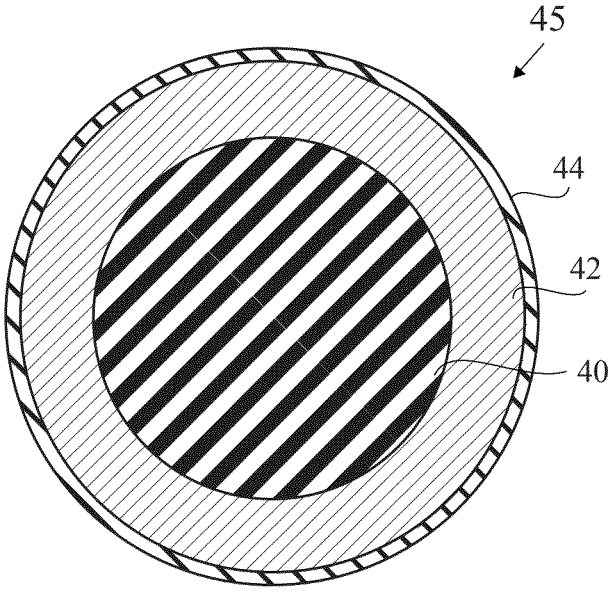
FIG. 17 is a cross-sectional view of a three-piece golf ball with a core, mantle and cover.

FIG. 17 illustrates a three piece golf ball 45 comprising a core 40, a mantle layer 42 and a cover 44, with an internal circuitry comprising at least a BLUETOOTH Low Energy radio ($5^{th}$ generation), a processor, a magnetometer, an accelerometer, and a battery. The internal circuit may also have a memory.

Figure 18:
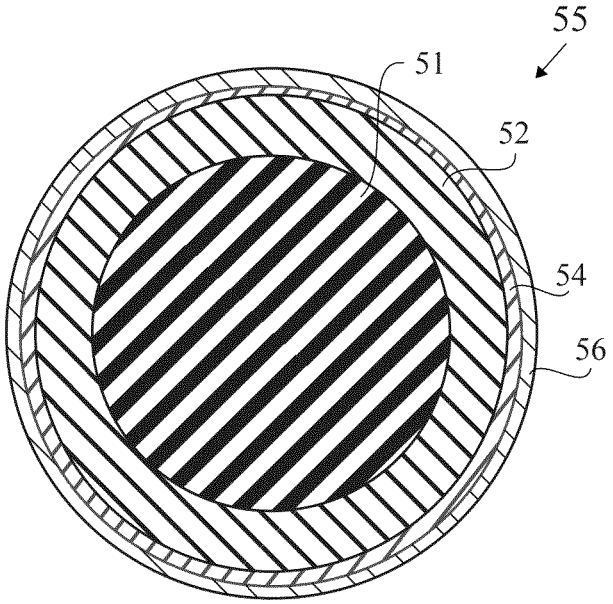
FIG. 18 is a cross-sectional view of a four-piece golf ball with a dual core, mantle layer and a cover.

FIG. 18 illustrates a dual core four piece golf ball 55 comprising an inner core 51, an outer core 52, a mantle layer 54 and a cover 56, with an internal circuitry comprising at least a BLUETOOTH Low Energy radio ($5^{th}$ generation), a processor, a magnetometer, an accelerometer, and a battery. The internal circuit may also have a memory.

Figure 19:
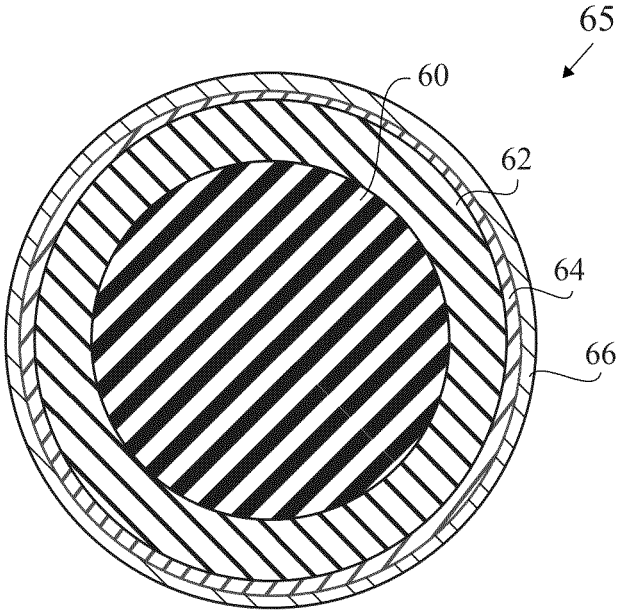
FIG. 19 is a cross-sectional view of a four-piece golf ball with a core, dual mantle layers and a cover.

FIG. 19 illustrates a four piece golf ball 65 comprising a core 60, an inner mantle 62, an outer mantle 64 and a cover 66, with an internal circuitry comprising at least a BLUETOOTH Low Energy radio ($5^{th}$ generation), a processor, a magnetometer, an accelerometer, and a battery. The internal circuit may also have a memory.

The mantle component is preferably composed of the inner mantle layer and the outer mantle layer. The mantle component preferably has a thickness ranging from 0.05 inch to 0.15 inch, and more preferably from 0.06 inch to 0.08 inch. The outer mantle layer is preferably composed of a blend of ionomer materials. One preferred embodiment comprises SURLYN 9150 material, SURLYN 8940 material, a SURLYN AD1022 material, and a masterbatch. The SURLYN 9150 material is preferably present in an amount ranging from 20 to 45 weight percent of the cover, and more preferably 30 to 40 weight percent. The SURLYN 8945 is preferably present in an amount ranging from 15 to 35 weight percent of the cover, more preferably 20 to 30 weight percent, and most preferably 26 weight percent. The SURLYN 9945 is preferably present in an amount ranging from 30 to 50 weight percent of the cover, more preferably 35 to 45 weight percent, and most preferably 41 weight percent. The SURLYN 8940 is preferably present in an amount ranging from 5 to 15 weight percent of the cover, more preferably 7 to 12 weight percent, and most preferably 10 weight percent.

SURLYN 8320, from DuPont, is a very-low modulus ethylene/methacrylic acid copolymer with partial neutralization of the acid groups with sodium ions. SURLYN 8945, also from DuPont, is a high acid ethylene/methacrylic acid copolymer with partial neutralization of the acid groups with sodium ions. SURLYN 9945, also from DuPont, is a high acid ethylene/methacrylic acid copolymer with partial neutralization of the acid groups with zinc ions. SURLYN 8940, also from DuPont, is an ethylene/methacrylic acid copolymer with partial neutralization of the acid groups with sodium ions.

The inner mantle layer is preferably composed of a blend of ionomers, preferably comprising a terpolymer and at least two high acid (greater than 18 weight percent) ionomers neutralized with sodium, zinc, magnesium, or other metal ions. The material for the inner mantle layer preferably has a Shore D plaque hardness ranging preferably from 35 to 77, more preferably from 36 to 44, a most preferably approximately 40. The thickness of the outer mantle layer preferably ranges from 0.025 inch to 0.050 inch, and is more preferably approximately 0.037 inch. The mass of an insert including the dual core and the inner mantle layer preferably ranges from 32 grams to 40 grams, more preferably from 34 to 38 grams, and is most preferably approximately 36 grams. The inner mantle layer is alternatively composed of a HPF material available from DuPont. Alternatively, the inner mantle layer **14*b*** is composed of a material such as disclosed in Kennedy, III et al., U.S. Pat. No. 7,361,101 for a Golf Ball And Thermoplastic Material, which is hereby incorporated by reference in its entirety.

The outer mantle layer is preferably composed of a blend of ionomers, preferably comprising at least two high acid (greater than 18 weight percent) ionomers neutralized with sodium, zinc, or other metal ions. The blend of ionomers also preferably includes a masterbatch. The material of the outer mantle layer preferably has a Shore D plaque hardness ranging preferably from 55 to 75, more preferably from 65 to 71, and most preferably approximately 67. The thickness of the outer mantle layer preferably ranges from 0.025 inch to 0.040 inch, and is more preferably approximately 0.030 inch. The mass of the entire insert including the core, the inner mantle layer and the outer mantle layer preferably ranges from 38 grams to 43 grams, more preferably from 39 to 41 grams, and is most preferably approximately 41 grams.

In an alternative embodiment, the inner mantle layer is preferably composed of a blend of ionomers, preferably comprising at least two high acid (greater than 18 weight percent) ionomers neutralized with sodium, zinc, or other metal ions. The blend of ionomers also preferably includes a masterbatch. In this embodiment, the material of the inner mantle layer has a Shore D plaque hardness ranging preferably from 55 to 75, more preferably from 65 to 71, and most preferably approximately 67. The thickness of the outer mantle layer preferably ranges from 0.025 inch to 0.040 inch, and is more preferably approximately 0.030 inch. Also in this embodiment, the outer mantle layer **14*b* is composed of a blend of ionomers, preferably comprising a terpolymer and at least two high acid (greater than 18 weight percent) ionomers neutralized with sodium, zinc, magnesium, or other metal ions. In this embodiment, the material for the outer mantle layer 14*b*** preferably has a Shore D plaque hardness ranging preferably from 35 to 77, more preferably from 36 to 44, a most preferably approximately 40. The thickness of the outer mantle layer preferably ranges from 0.025 inch to 0.100 inch, and more preferably ranges from 0.070 inch to 0.090 inch.

In yet another embodiment wherein the inner mantle layer is thicker than the outer mantle layer and the outer mantle layer is harder than the inner mantle layer, the inner mantle layer is composed of a blend of ionomers, preferably comprising a terpolymer and at least two high acid (greater than 18 weight percent) ionomers neutralized with sodium, zinc, magnesium, or other metal ions. In this embodiment, the material for the inner mantle layer has a Shore D plaque hardness ranging preferably from 30 to 77, more preferably from 30 to 50, and most preferably approximately 40. In this embodiment, the material for the outer mantle layer has a Shore D plaque hardness ranging preferably from 40 to 77, more preferably from 50 to 71, and most preferably approximately 67. In this embodiment, the thickness of the inner mantle layer preferably ranges from 0.030 inch to 0.090 inch, and the thickness of the outer mantle layer ranges from 0.025 inch to 0.070 inch.

Preferably the inner core has a diameter ranging from 0.75 inch to 1.20 inches, more preferably from 0.85 inch to 1.05 inch, and most preferably approximately 0.95 inch. Preferably the inner core 12*a* has a Shore D hardness ranging from 20 to 50, more preferably from 25 to 40, and most preferably approximately 35. Preferably the inner core is formed from a polybutadiene, zinc diacrylate, zinc oxide, zinc stearate, a peptizer and peroxide. Preferably the inner core has a mass ranging from 5 grams to 15 grams, 7 grams to 10 grams and most preferably approximately 8 grams.

Preferably the outer core has a diameter ranging from 1.25 inch to 1.55 inches, more preferably from 1.40 inch to 1.5 inch, and most preferably approximately 1.5 inch. Preferably the inner core has a Shore D surface hardness ranging from 40 to 65, more preferably from 50 to 60, and most preferably approximately 56. Preferably the inner core is formed from a polybutadiene, zinc diacrylate, zinc oxide, zinc stearate, a peptizer and peroxide. Preferably the combined inner core and outer core have a mass ranging from 25 grams to 35 grams, 30 grams to 34 grams and most preferably approximately 32 grams.

Figure 6:
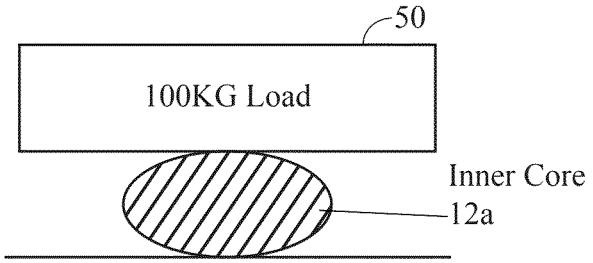
FIG. 6 is a cross-sectional view of an inner core layer under a 100 kilogram load.
Figure 7:
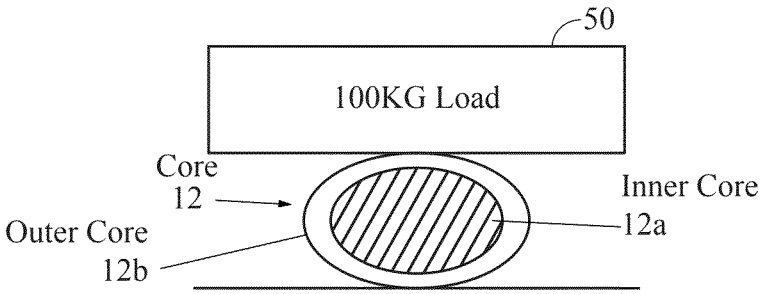
FIG. 7 is a cross-sectional view of a core under a 100 kilogram load.

Preferably the inner core has a deflection of at least 0.230 inch under a load of 220 pounds, and the core has a deflection of at least 0.080 inch under a load of 200 pounds. As shown in FIGS. 6 and 7, a mass 50 is loaded onto an inner core and a core. As shown in FIGS. 6 and 7, the mass is 100 kilograms, approximately 220 pounds. Under a load of 100 kilograms, the inner core preferably has a deflection from 0.230 inch to 0.300 inch. Under a load of 100 kilograms, preferably the core has a deflection of 0.08 inch to 0.150 inch. Alternatively, the load is 200 pounds (approximately 90 kilograms), and the deflection of the core 12 is at least 0.080 inch. Further, a compressive deformation from a beginning load of 10 kilograms to an ending load of 130 kilograms for the inner core ranges from 4 millimeters to 7 millimeters and more preferably from 5 millimeters to 6.5 millimeters. The dual core deflection differential allows for low spin off the tee to provide greater distance, and high spin on approach shots.

In an alternative embodiment of the golf ball shown in FIG. 5A, the golf ball 10 comprises an inner core 12*a*, an intermediate core 12*c*, an outer core 12*b*, a mantle 14 and a cover 16. The golf ball 10 preferably has a diameter of at least 1.68 inches, a mass ranging from 45 grams to 47 grams, a COR of at least 0.79, a deformation under a 100 kilogram loading of at least 0.07 mm.

In one embodiment, the golf ball comprises a core, a mantle layer and a cover layer. The core comprises an inner core sphere, an intermediate core layer and an outer core layer. The inner core sphere comprises a polybutadiene material and has a diameter ranging from 0.875 inch to 1.4 inches. The intermediate core layer is composed of a highly neutralized ionomer and has a Shore D hardness less than 40. The outer core layer is composed of a highly neutralized ionomer and has a Shore D hardness less than 45. A thickness of the intermediate core layer is greater than a thickness of the outer core layer. The mantle layer is disposed over the core, comprises an ionomer material and has a Shore D hardness greater than 55. The cover layer is disposed over the mantle layer comprises a sprayed polyurea with a thickness ranging from 0.010 inch to 0.040 inch. The golf ball has a diameter of at least 1.68 inches. The mantle layer is harder than the outer core layer, the outer core layer is harder than the intermediate core layer, the intermediate core layer is harder than the inner core sphere, and the cover layer is softer than the mantle layer.

In another embodiment, shown in FIGS. 8 and 9, the golf ball 10 has a multi-layer core and multi-layer mantle. The golf ball includes a core, a mantle component and a cover layer. The core comprises an inner core sphere 12*a*, an intermediate core layer 12*c* and an outer core layer 12*b*. The inner core sphere comprises a polybutadiene material and has a diameter ranging from 0.875 inch to 1.4 inches. The intermediate core layer is composed of a highly neutralized ionomer and has a Shore D hardness less than 40. The outer core layer is composed of a highly neutralized ionomer and has a Shore D hardness less than 45. A thickness of the intermediate core layer 12*c* is greater than a thickness of the outer core layer 12*b*. The inner mantle layer is disposed over the core, comprises an ionomer material and has a Shore D hardness greater than 55. The outer mantle layer is disposed over the inner mantle layer, comprises an ionomer material and has a Shore D hardness greater than 60. The cover layer is disposed over the mantle component, comprises a sprayed polyurea with a thickness ranging from 0.010 inch to 0.040 inch. The golf ball has a diameter of at least 1.68 inches. The outer mantle layer is harder than the inner mantle layer, the inner mantle layer is harder than the outer core layer, the outer core layer is harder than the intermediate core layer, the intermediate core layer is harder than the inner core sphere, and the cover layer is softer than the outer mantle layer.

In a particularly preferred embodiment of the invention, the golf ball preferably has an aerodynamic pattern such as disclosed in Simonds et al., U.S. Pat. No. 7,419,443 for a Low Volume Cover For A Golf Ball, which is hereby incorporated by reference in its entirety. Alternatively, the golf ball has an aerodynamic pattern such as disclosed in Simonds et al., U.S. Pat. No. 7,338,392 for An Aerodynamic Surface Geometry For A Golf Ball, which is hereby incorporated by reference in its entirety.

Various aspects of the present invention golf balls have been described in terms of certain tests or measuring procedures. These are described in greater detail as follows.

As used herein, "Shore D hardness" of the golf ball layers is measured generally in accordance with ASTM D-2240 type D, except the measurements may be made on the curved surface of a component of the golf ball, rather than on a plaque. If measured on the ball, the measurement will indicate that the measurement was made on the ball. In referring to a hardness of a material of a layer of the golf ball, the measurement will be made on a plaque in accordance with ASTM D-2240. Furthermore, the Shore D hardness of the cover is measured while the cover remains over the mantles and cores. When a hardness measurement is made on the golf ball, the Shore D hardness is preferably measured at a land area of the cover.

As used herein, "Shore A hardness" of a cover is measured generally in accordance with ASTM D-2240 type A, except the measurements may be made on the curved surface of a component of the golf ball, rather than on a plaque. If measured on the ball, the measurement will indicate that the measurement was made on the ball. In referring to a hardness of a material of a layer of the golf ball, the measurement will be made on a plaque in accordance with ASTM D-2240. Furthermore, the Shore A hardness of the cover is measured while the cover remains over the mantles and cores. When a hardness measurement is made on the golf ball, Shore A hardness is preferably measured at a land area of the cover The resilience or coefficient of restitution (COR) of a golf ball is the constant "e," which is the ratio of the relative velocity of an elastic sphere after direct impact to that before impact. As a result, the COR ("e") can vary from 0 to 1, with 1 being equivalent to a perfectly or completely elastic collision and 0 being equivalent to a perfectly or completely inelastic collision.

COR, along with additional factors such as club head speed, club head mass, ball weight, ball size and density, spin rate, angle of trajectory and surface configuration as well as environmental conditions (e.g. temperature, moisture, atmospheric pressure, wind, etc.) generally determine the distance a ball will travel when hit. Along this line, the distance a golf ball will travel under controlled environmental conditions is a function of the speed and mass of the club and size, density and resilience (COR) of the ball and other factors. The initial velocity of the club, the mass of the club and the angle of the ball's departure are essentially provided by the golfer upon striking. Since club head speed, club head mass, the angle of trajectory and environmental conditions are not determinants controllable by golf ball producers and the ball size and weight are set by the U.S.G.A., these are not factors of concern among golf ball manufacturers. The factors or determinants of interest with respect to improved distance are generally the COR and the surface configuration of the ball.

The coefficient of restitution is the ratio of the outgoing velocity to the incoming velocity. In the examples of this application, the coefficient of restitution of a golf ball was measured by propelling a ball horizontally at a speed of 125+/−5 feet per second (fps) and corrected to 125 fps against a generally vertical, hard, flat steel plate and measuring the ball's incoming and outgoing velocity electronically. Speeds were measured with a pair of ballistic screens, which provide a timing pulse when an object passes through them. The screens were separated by 36 inches and are located 25.25 inches and 61.25 inches from the rebound wall. The ball speed was measured by timing the pulses from screen 1 to screen 2 on the way into the rebound wall (as the average speed of the ball over 36 inches), and then the exit speed was timed from screen 2 to screen 1 over the same distance. The rebound wall was tilted 2 degrees from a vertical plane to allow the ball to rebound slightly downward in order to miss the edge of the cannon that fired it. The rebound wall is solid steel.

As indicated above, the incoming speed should be 125±5 fps but corrected to 125 fps. The correlation between COR and forward or incoming speed has been studied and a correction has been made over the ±5 fps range so that the COR is reported as if the ball had an incoming speed of exactly 125.0 fps.

The measurements for deflection, compression, hardness, and the like are preferably performed on a finished golf ball as opposed to performing the measurement on each layer during manufacturing.

Preferably, in a five layer golf ball comprising an inner core, an outer core, an inner mantle layer, an outer mantle layer and a cover, the hardness/compression of layers involve an inner core with the greatest deflection (lowest hardness), an outer core (combined with the inner core) with a deflection less than the inner core, an inner mantle layer with a hardness less than the hardness of the combined outer core and inner core, an outer mantle layer with the hardness layer of the golf ball, and a cover with a hardness less than the hardness of the outer mantle layer. These measurements are preferably made on a finished golf ball that has been torn down for the measurements.

Preferably the inner mantle layer is thicker than the outer mantle layer or the cover layer. The dual core and dual mantle golf ball creates an optimized velocity-initial velocity ratio (Vi/IV), and allows for spin manipulation. The dual core provides for increased core compression differential resulting in a high spin for short game shots and a low spin for driver shots. A discussion of the USGA initial velocity test is disclosed in Yagley et al., U.S. Pat. No. 6,595,872 for a Golf Ball With High Coefficient Of Restitution, which is hereby incorporated by reference in its entirety. Another example is Bartels et al., U.S. Pat. No. 6,648,775 for a Golf Ball With High Coefficient Of Restitution, which is hereby incorporated by reference in its entirety.

Alternatively, the cover 16 is composed of a thermoplastic polyurethane/polyurea material. One example is disclosed in U.S. Pat. No. 7,367,903 for a Golf Ball, which is hereby incorporated by reference in its entirety. Another example is Melanson, U.S. Pat. No. 7,641,841, which is hereby incorporated by reference in its entirety. Another example is Melanson et al, U.S. Pat. No. 7,842,211, which is hereby incorporated by reference in its entirety. Another example is Matroni et al., U.S. Pat. No. 7,867,111, which is hereby incorporated by reference in its entirety. Another example is Dewanjee et al., U.S. Pat. No. 7,785,522, which is hereby incorporated by reference in its entirety.

Bartels, U.S. Pat. No. 9,278,260, for a Low Compression Three-Piece Golf Ball With An Aerodynamic Drag Rise At High Speeds, is hereby incorporated by reference in its entirety.

Chavan et al, U.S. Pat. No. 9,789,366, for a Graphene Core For A Golf Ball, is hereby incorporated by reference in its entirety.

Chavan et al, U.S. patent application Ser. No. 15/705,011, filed on Sep. 14, 2017, for a Graphene Core For A Golf Ball, is hereby incorporated by reference in its entirety.

Chavan et al, U.S. patent application Ser. No. 15/729,231, filed on Oct. 10, 2017, for a Graphene And Nanotube Reinforced Golf Ball, is hereby incorporated by reference in its entirety.

Simonds et al., U.S. Pat. No. 9,707,454 for a Limited Flight Golf Ball With Embedded RFID Chip is hereby incorporated by reference in its entirety.

Balardeta et al., U.S. Pat. No. 8,355,869 for a Golf GPS Device is hereby incorporated by reference in its entirety.

Raposo, U.S. Pat. No. 8,992,346 for a Method And System For Swing Analysis is hereby incorporated by reference in its entirety.

Balardeta et al., U.S. Pat. No. 8,845,459 for a Method And System For Shot Tracking is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention the following:

1. A system for obtaining golf ball launch parameters, the system comprising:

a golf ball with a plurality of sensors therein, the plurality of sensors comprising an accelerometer and magnetometer, the golf ball also comprising a transceiver;

a vertical wall;

a monitor comprising a processor and a transceiver;

wherein the golf ball is teed at a known distance to the vertical wall;

wherein the processor is configured to calculate a height of the golf ball at impact based on the time the golf ball takes to fall to the floor after impact with the vertical wall;

wherein the processor is configured to calculate the launch angle of the golf ball based on the height of the golf ball at impact with the vertical wall;

wherein the processor is configured to calculate a ball speed based on the time from club impact to wall impact and distance from the ball at rest to the ball at impact height;

wherein the processor is configured to calculate a spin and spin axis from magnetometer readings; and wherein the processor is configured to calculate a path angle of the golf ball until wall impact based on the spin axis in relation to a gravitational reference plane defined by the values for the accelerometer and magnetometer at rest;

wherein the magnetometer operates at 85 Hertz or greater.

2. The system according to claim 1 wherein processor is configured to calculate a spin and spin axis from magnetometer readings by capturing a 3-axis of magnetometer data during ball flight up to wall impact; wherein the rotations result in a sinusoidal oscillations of all 3 axis readings; wherein the averages of these oscillations on each axis define the spin axis; wherein the resultant X, Y, magnetometer readings define total spin.

3. A system for obtaining golf ball launch parameters, the system comprising:

a golf ball comprising an epoxy sphere comprising a body and an electronic component, the electronic component comprising an integrated circuit, a gyroscope, a magnetometer, and a BLUETOOTH low energy (BTLE) radio, and at least one battery, the body composed of an epoxy material, wherein the body encompasses the electronic component, a core layer disposed on the epoxy sphere, and a cover layer disposed over the core layer, wherein the BTLE radio has a range of at least 700 meters;

a vertical wall;

a monitor comprising a processor and a transceiver;

wherein the golf ball is teed at a known distance to the vertical wall;

wherein the processor is configured to calculate a height of the golf ball at impact based on the time the golf ball takes to fall to the floor after impact with the vertical wall;

wherein the processor is configured to calculate the launch angle of the golf ball based on the height of the golf ball at impact with the vertical wall;

wherein the processor is configured to calculate a ball speed based on the time from club impact to wall impact and distance from the ball at rest to the ball at impact height;

wherein the processor is configured to calculate a spin and spin axis from magnetometer readings;

wherein the processor is configured to calculate a path angle of the golf ball until wall impact based on the spin axis in relation to a gravitational reference plane defined by the values for the accelerometer and magnetometer at rest; and wherein the magnetometer operates at 85 Hertz or greater.

* * * * *